US006827301B1

(12) United States Patent
Kassuba

(10) Patent No.: US 6,827,301 B1
(45) Date of Patent: Dec. 7, 2004

(54) CRUSHING—BREAKING APPARATUS

(75) Inventor: Steven M. Kassuba, 1219 Five Lakes Rd., Gaylord, MI (US) 49735

(73) Assignees: Patrick Copeland, Toledo, OH (US); part interest; Howard R. Wood, Gaylord, MI (US); part interest; Steven M. Kassuba, Gaylord, MI (US); part interest ( * ) Notice: Subject to any disclaimer, the term of this patent is extended or adjusted under 35 U.S.C. 154(b) by 342 days.

(21) Appl. No.: 09/919,277

(22) Filed: Jul. 31, 2001

(51) Int. Cl.[7] ..... B02C 1/06
(52) U.S. Cl. ..... 241/37; 241/266
(58) Field of Search ..... 241/264–269, 241/37

(56) References Cited

U.S. PATENT DOCUMENTS

| | | | |
|---|---|---|---|
| 3,156,421 A | 11/1964 | Lutz | 241/217 |
| 4,768,723 A | 9/1988 | Fritz | 241/268 |
| 5,462,237 A | 10/1995 | Wellmann | 241/57 |
| 5,791,573 A | 8/1998 | Okuya | 241/264 |
| 6,145,768 A | 11/2000 | Okuya | 241/265 |

FOREIGN PATENT DOCUMENTS

| | | |
|---|---|---|
| CH | 656325 | 6/1986 |
| DE | 251533 | 5/1911 |
| DE | 1085401 | 7/1960 |
| DE | 2621043 | 12/1976 |
| FR | 2409474 | 6/1979 |
| JP | 27-9879 | 11/1927 |
| JP | 55-6801 | 6/1952 |
| JP | 54-3953 | 1/1979 |
| JP | 54-39261 | 3/1979 |
| JP | 60-33542 | 4/1985 |
| JP | 62-279849 | 2/1987 |
| JP | 62-95736 | 6/1987 |
| JP | 5-184959 | 7/1993 |
| JP | 6-106083 | 4/1994 |
| JP | 6-182238 | 7/1994 |
| WO | WO85/03887 | 9/1985 |

*Primary Examiner*—Mark Rosenbaum
(74) *Attorney, Agent, or Firm*—Lon H. Romanski

(57) ABSTRACT

A crushing breaking—apparatus is shown having opposed jaw like members between which work to be crushed is placed; the jaw like members are brought closer to each other and in so doing the work becomes crushed; during loading and crushing of the work the lower ends of the jaw like members are held so close to each as to prevent the work, in the main, from falling out from the jaw like members.

7 Claims, 19 Drawing Sheets

CRUSHING— BREAKING APPARATUS

FIELD OF THE INVENTION

This invention relates generally to the field of crushing—breaking apparatus and more particularly to crushing—breaking apparatus for use in crushing and/or breaking, for example, unnecessary cast weirs, runners and ingates as well as crushing and/or breaking other cast scrap or useless products.

BACKGROUND OF THE INVENTION

Generally, the prior art has proposed jaw type crushing apparatus wherein a pair of opposed jaw-like members carry cutlery members or devices. When material to be worked on is introduced between the cutlery members carried by one of the jaw-like members, and the cutlery devices carried by the other of the jaw-like members, such material, or work, is acted upon, primarily frangibly, by the cutlery devices as said jaw-like said jaw-like members are brought relatively closer to each other.

Some prior art devices employed only one movable jaw-like member which was movable toward and away from the other jaw-like member which was fixed in location.

Other prior art crusher devices provided somewhat of an abutment-like extension as at the lower end or ends of the jaw or jaws in an attempt to prevent too large of broken pieces, of the work, to fall through the space generally between the jaws.

Still other prior art structures or devices proposed having both jaw-like members movable with respect to each other. In such prior art devices it was also found that too large of broken pieces, of the work, would fall through the space generally between the jaws.

Accordingly, the invention as herein disclosed and described is primarily directed to crusher or crushing/breaking apparatus improved over the prior art and which is effective to produce broken pieces, of the work, of a size not exceeding a desired maximum size.

SUMMARY OF THE INVENTION

According to the invention, a crushing—breaking apparatus comprises a frame having side plates facing each other and spaced apart a predetermined distance, a first cutlery device provided in said frame, said first cutlery device comprising a plurality of first projection-shaped cutleries, a second cutlery device provided in said frame, said second cutlery device comprising a plurality of second projection-shaped cutleries, said plurality of second projection-shaped cutleries being disposed on said second cutlery device at locations offset relative to said first projection-shaped cutleries of said cutlery device, first pivot means for pivotally supporting said first cutlery device, second pivot means for pivotally supporting said second cutlery device, said first cutlery device comprising a relatively upper end and a relatively lower end, said second cutlery device comprising a relatively upper end and a relatively lower end, wherein said first pivot means is situated at least near said relatively upper end of said first cutlery device, wherein said second pivot means is situated at least neat said relatively lower end of said second cutlery device, first abutment means effective for at times engaging said first cutlery device to thereby stop motion of said first cutlery device about said first pivot means, second abutment means effective for at times engaging said second cutlery device to thereby stop motion of said second cutlery device about said second pivot means, first motor means operatively connected to said first cutlery device at an area thereof which is at least closer to said lower end of said first cutlery device than to said upper end of said first cutlery device, and second motor means operatively connected to said second cutlery device at an area thereof which is at least closer to said upper end of said second cutlery device than to said lower end of said second cutlery device, said first motor means being effective to pivotally move said first cutlery device about said first pivot means as to thereby move said relatively lower end of said first cutlery device toward said second cutlery device, said second motor means being effective to pivotally move said second cutlery device about said second pivot means and generally toward said first cutlery device, wherein said first cutlery device continues to so move toward said second cutlery device and said second cutlery continues to so move toward said first cutlery device as to place said relatively lower end of said first cutlery device juxtaposed to said relatively lower end of said second cutlery device and to place said relatively upper ends of said first and second cutlery devices spaced from each other and defining an inlet for placing work to be crushed between said first cutlery device and said second cutlery device.

Other general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements are omitted from one or more views.

DETAILED DESCRIPTION OF THE PREFERRED EMBODIMENT

Figure 1:
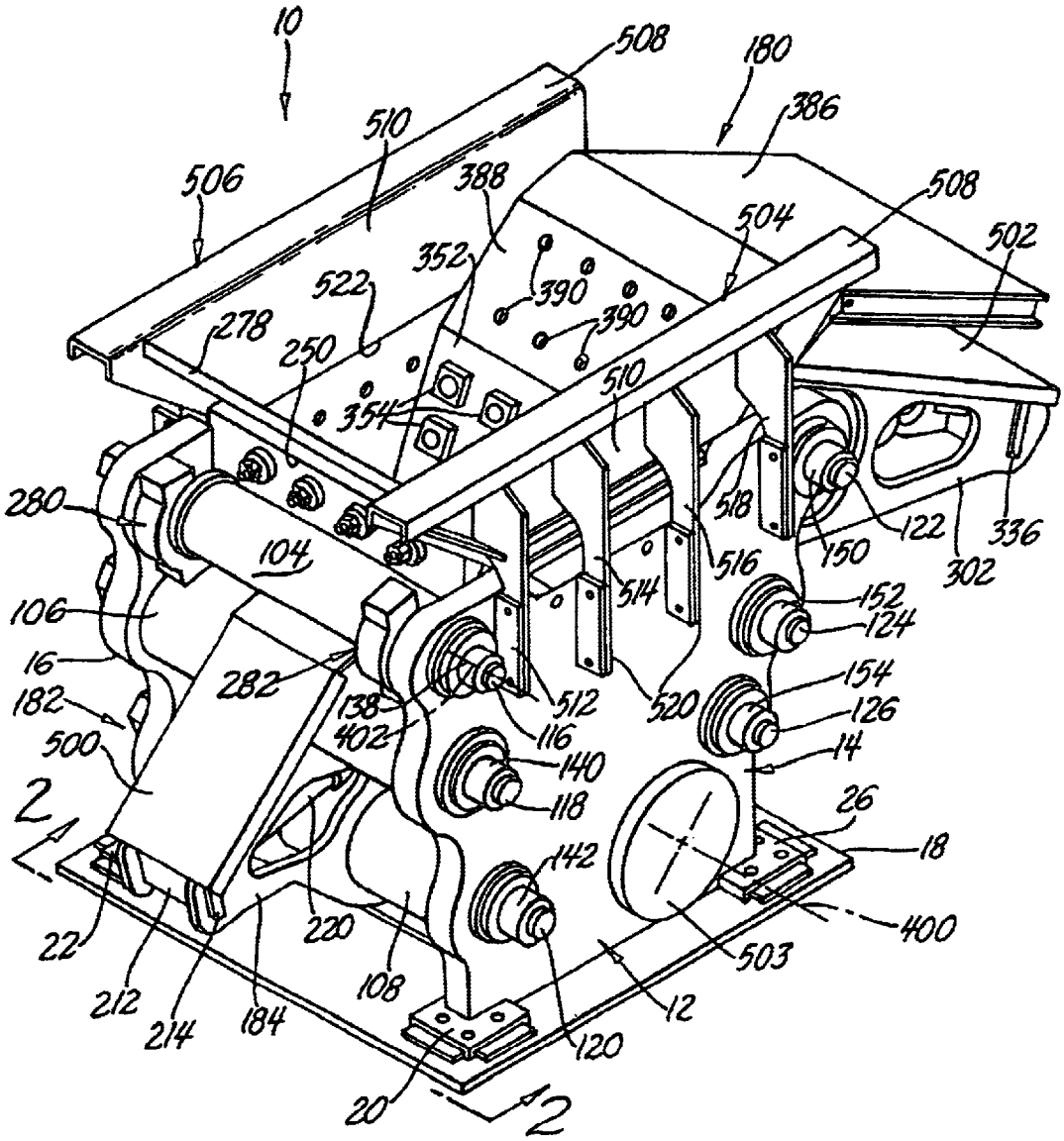
FIG. 1 is a perspective view of a crusher employing teachings of the invention.

Referring in particular to FIGS. 1, 2, 3, 4 and 5, the preferred embodiment of the crusher or breaker assembly 10 is illustrated as comprising a main body or housing 12 in turn comprising generally vertically extending right hand side plate 14 and left hand side plate 16 which are preferably situated upon and suitably fixedly secured to a base plate or member 18 provided as with cleat-like members 20, 22, 24 and 26.

Figure 2:
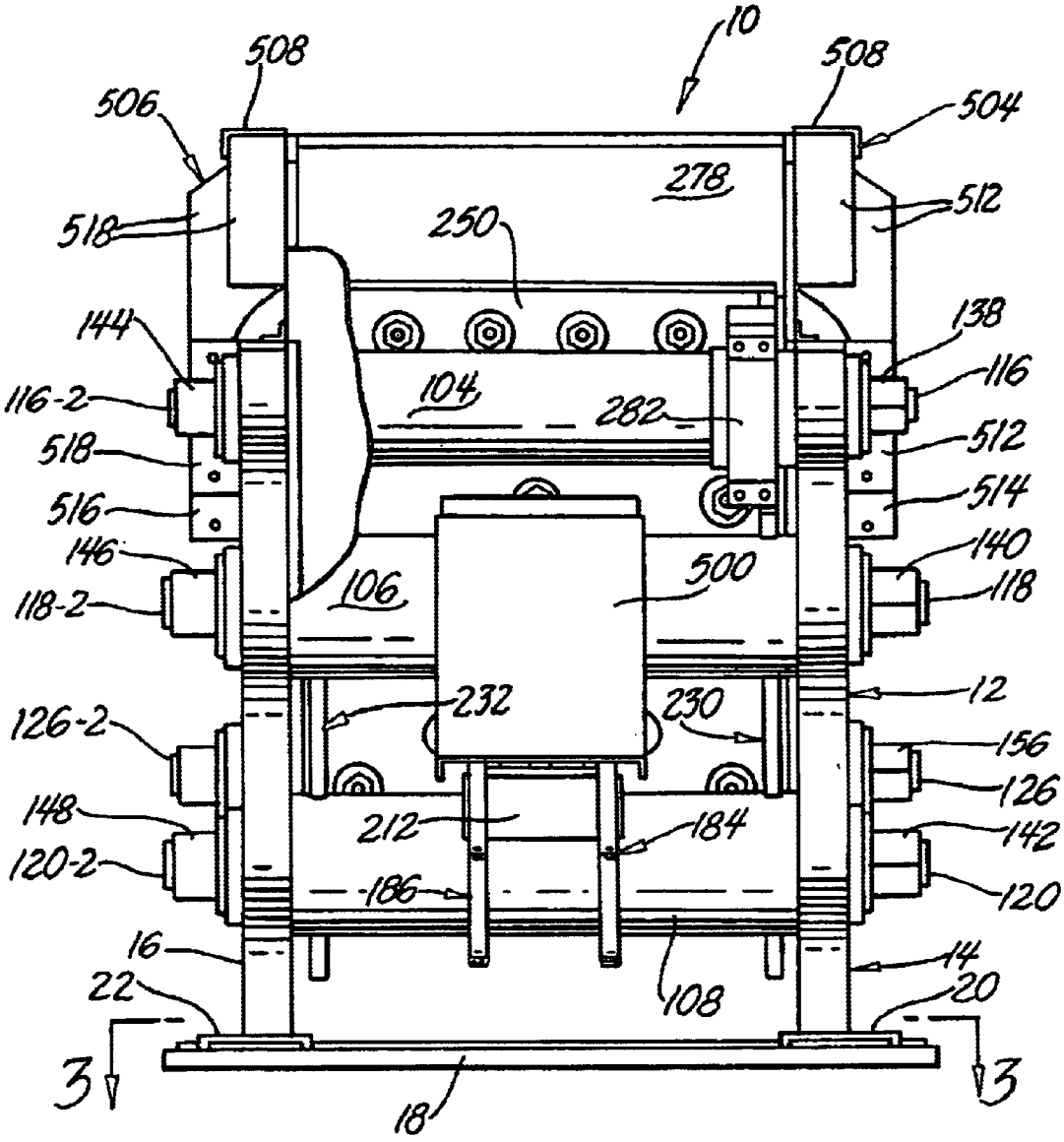
FIG. 2 is an end elevational view of the crusher of FIG. 1 taken on the plane of line 2—-2 of FIG. 1 and looking in the direction of the arrows.
Figure 3:
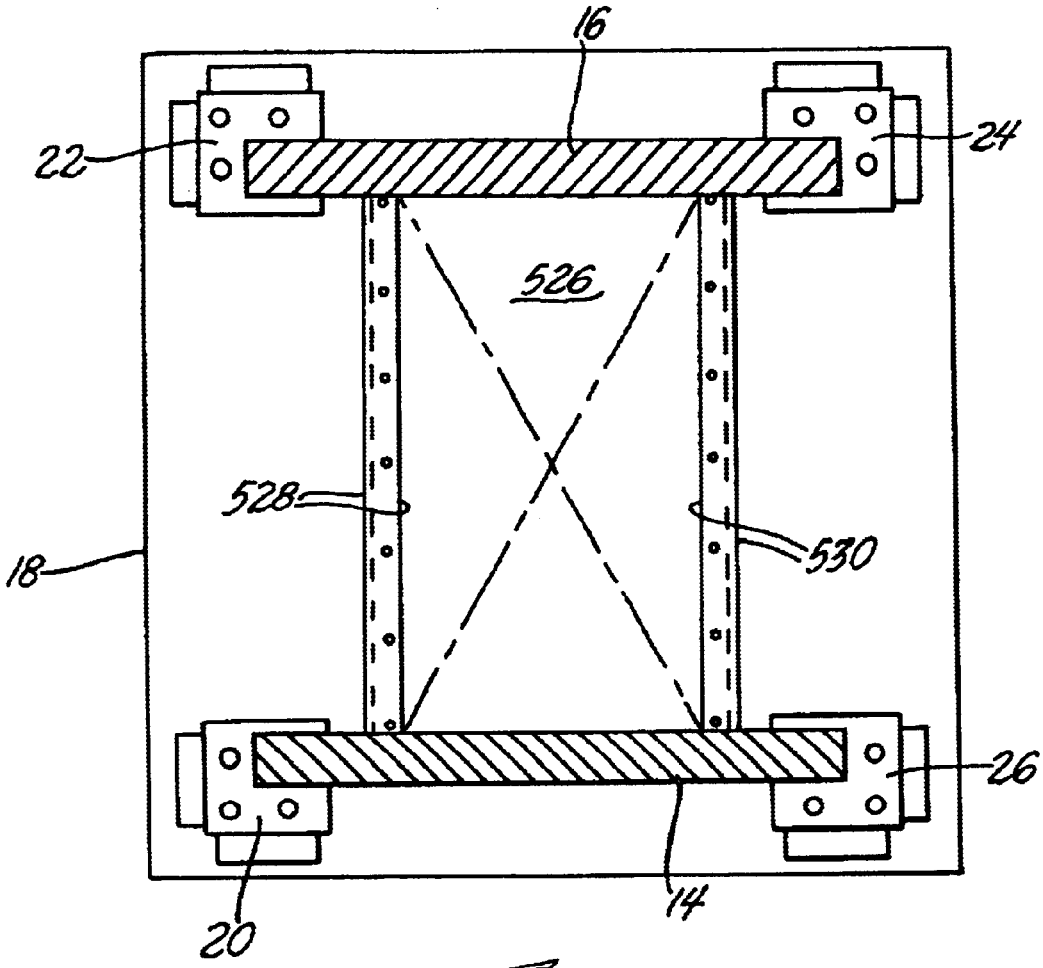
FIG. 3 is a cross-sectional view taken generally on the plane of line 3—3 of FIG. 2, looking in the direction of the arrows, and being rotated 90° from that of FIG. 2, depicting the generally open passage or space for the broken or crushed pieces of work to fall therethrough.
Figure 4:
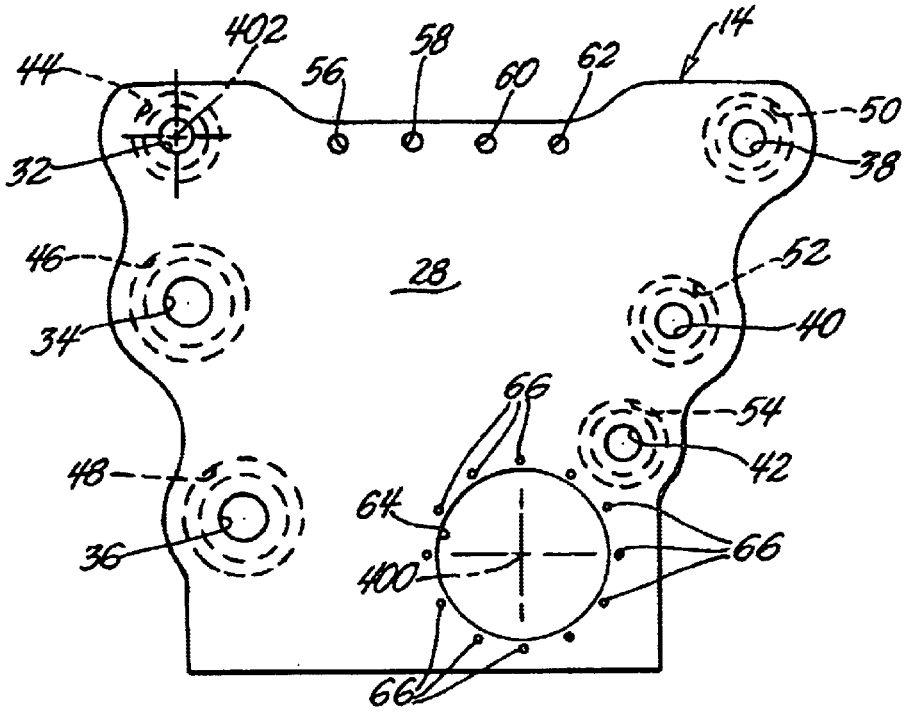
FIG. 4 is a side elevational view of the right hand side plate of the crusher assembly of FIGS. 1 and 2.
Figure 5:
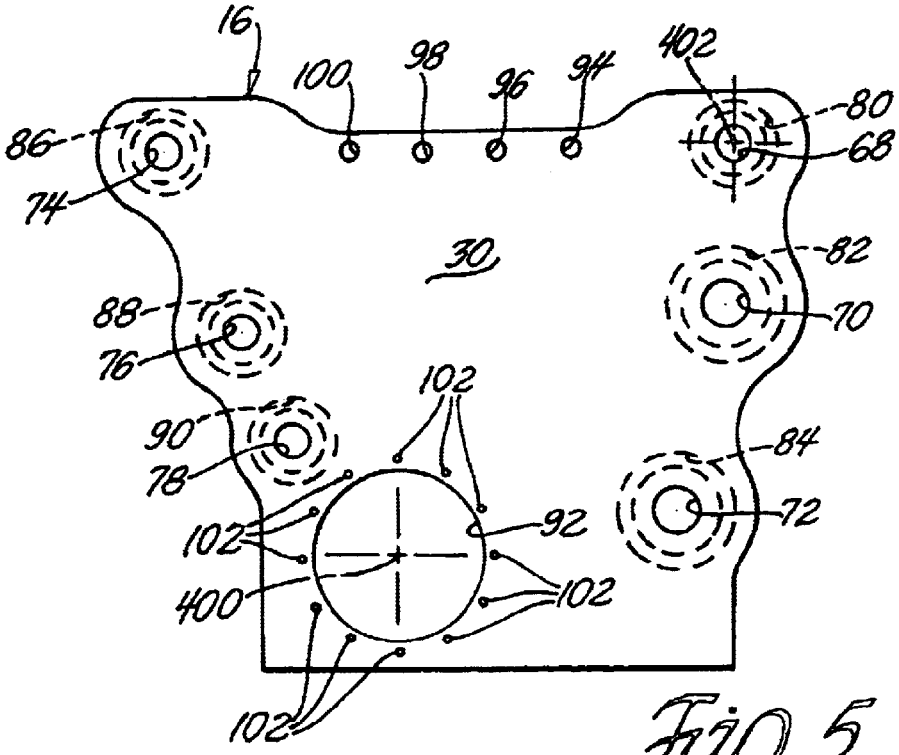
FIG. 5 is a side elevational view of the left hand side plate of the crusher assembly of FIGS. 1 and 2 and opposite to the right hand side plate.

In reviewing side plate supporting means 14 and 16, of FIGS. 4 and 5, the respective surfaces shown, at 28 and 30, may be considered and referred to as outside surfaces in that, as best depicted in FIGS. 1 and 2, for example, for the most part the other elements of the overall assembly 10 are situated between and therefore inside of support or housing members 14 and 16.

Referring to FIG. 4, the right side wall or support 14 is provided with passages 32, 34, 36, 38, 40 and 42 formed therethrough with counterbores 44, 46, 48, 50, 52 and 54 respectively formed thereabout. Near the upper end of support or housing member 14, a plurality of passages 56, 58, 60 and 62 are provided which, preferably, are of diameters smaller than those of 32–42. Also, at the generally lower portion of support wall 14, a relatively large passage 64 is formed therethrough and a plurality of relatively small orifices or passages 66 may be formed thereabout.

Referring now to FIG. 5, the wall member or plate 16 is, in effect, the reverse of plate member 14 and has: (a) passages 68, 70, 72, 74, 76 and 78 which respectively correspond to passages 32–42; (b) counterbores 80, 82, 84, 86, 88 and 90 which respectively correspond to counterbores 44–54; (c) relatively enlarged passage 92 corresponding to passage 64; and (d) a plurality of passages 94, 96, 98 and 100 correspoding to passages 56, 58, 60 and 62. Similar to FIG. 4, a plurality of relatively small orifices or passages 102 may be formed about passage 92.

Figure 6:
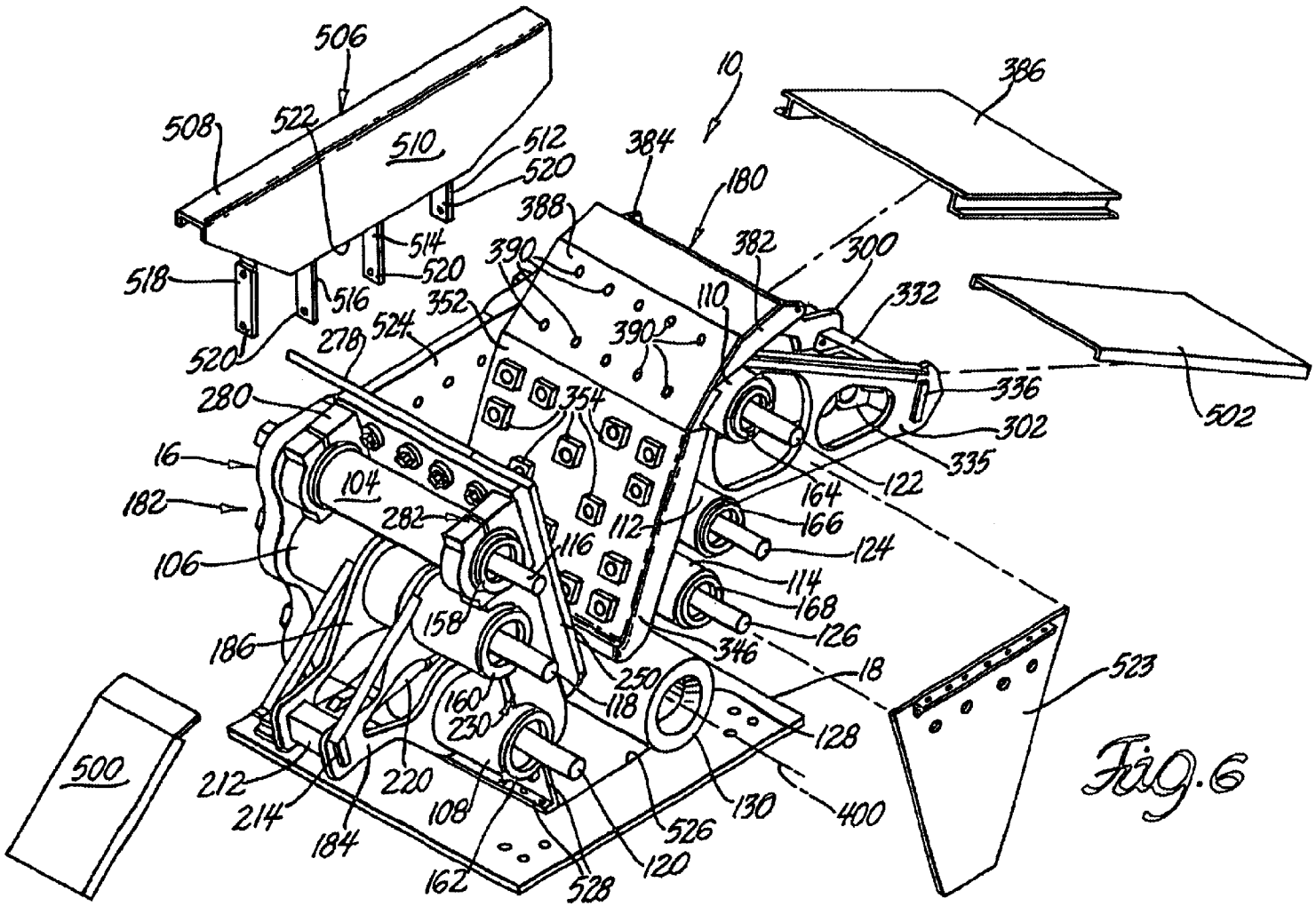
FIG. 6 is a partially exploded and perspective view of a portion of the crusher or breaker assembly of FIGS. 1 and 2.
Figure 7:
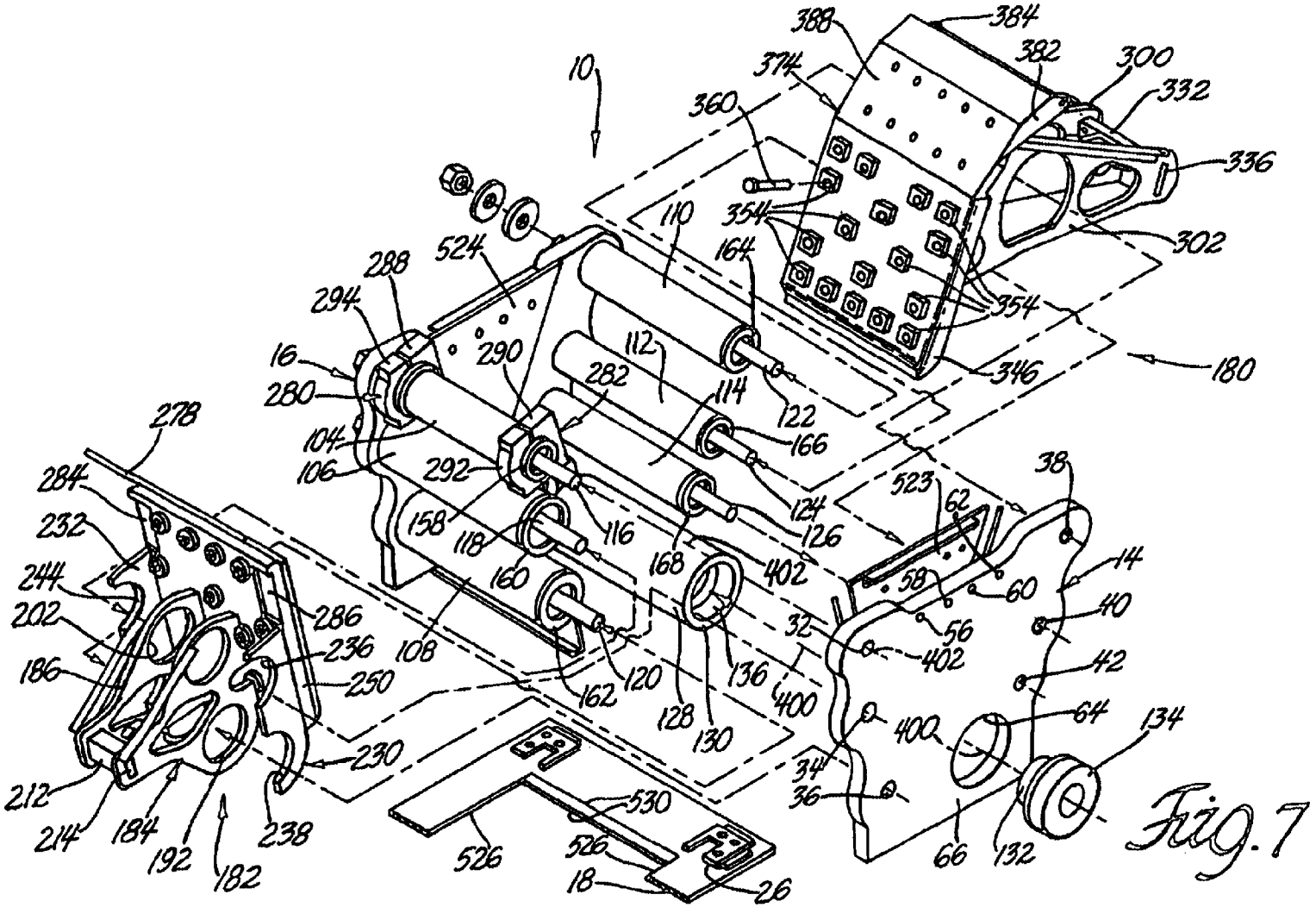
FIG. 7 is a further exploded and perspective view of the crusher assembly of FIGS. 1 and 2 illustrating in greater detail the directions of assembly of elements within the view.

Now also referring to FIGS. 6 and 7, the crusher or breaker assembly 10, in its preferred embodiment, comprises a plurality of cylindrical members 104, 106, 108, 110, 112 and 114 respectively having axle or extension like portions or members 116, 118, 120, 122, 124 and 126. Further, a diametrically relatively enlarged cylindrical member 128 preferably has an open end portion 130 which accommodates an axially directed extension 132 (FIG. 7) of member 134. At assembly, end member 134 is received by and retained in aperture or passage 64 and in so doing has its end projection or extension received by the journal surface 136 of end 130 of cylindrical member 128. The opposite axial end of member 128 is preferably formed similarly to that of 130 and 136, and end plate 16 also similarly receives a member such as 134, within its aperture or passage 92 so as to have said opposite end of cylindrical member 128 journald thereby.

As generally depicted by FIGS. 1, 2, 6 and 7, upon assembly extensions 116, 118 and 120 are respectively received in passages 32, 34 and 36 as to extend therethrough and be secured as by associated fastener means 138, 140 and 142. The opposite end extensions 116-2, 118-2 and 120-2 respectively similarly extend through passages (FIG. 5) 68, 70 and 72 and are secured as by suitable fastener means 144, 146 and 148.

Further, axial-like extensions 122, 124 and 126 are respectively received in and extend through passages 38, 40 and 42 (FIGS. 1, 2, 4, 6 and 7) and are secured as by associated fastener means 150, 152 and 154. Similarly, as with regard to extensions 116-2, 118-2 and 120-2, opposite axial end portions are provided and respectively extend through passages 74, 76 and 78 (FIG. 5). Such opposite axial end portions (opposite to 122, 124 and 126) respectively axially extend through passages 74, 76 and 78 (FIG. 5) and are also secured in such passages in side plate or housing member 16. As typically depicted in FIG. 2, end 126-2 of cylindrical member 114, extending through passage 78, is secured in such location by coacting suitable fastener means 156.

In the preferred embodiment, roller-like cylindrical members 104, 106 and 108 are formed or provided with respective annular extensions 158, 160 and 162 at the one ends thereof, as generally depicted in FIGS. 6, 7, 14 and 15. Similarly, roller-like cylindrical members 110, 112, and 114 are formed or provided with respective annular axial extensions 164, 166 and 168 at the one ends thereof, as generally depicted in FIGS. 6, 7, 16 and 17.

Figure 14:
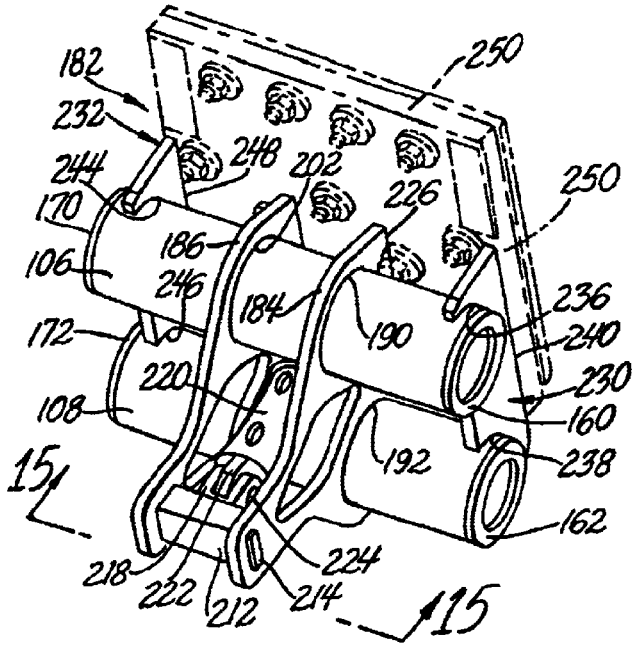
FIG. 14 is a perspective view of the left hand and right hand back cylinder plates assembled to a pressure cylinder assembly and showing the left hand and right hand cylinder stop plates carried by cylinder members for abutting engagement with a back panel member.
Figure 15:
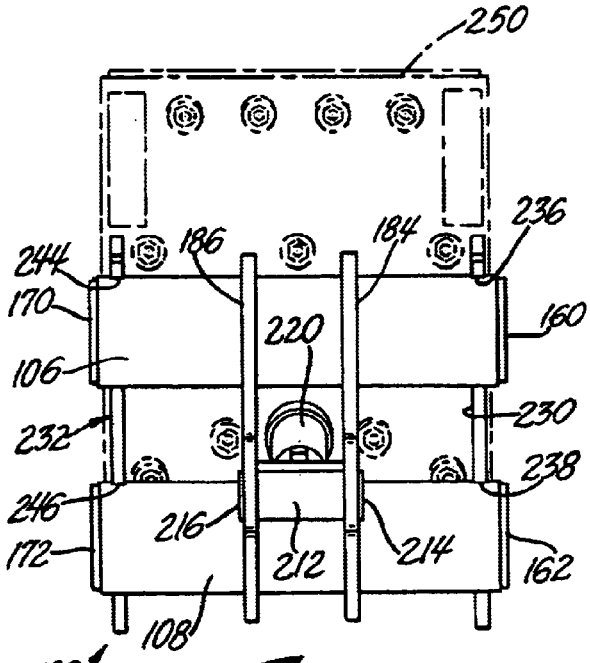
FIG. 15 is an end view taken on the plane of line 15—15 in FIG. 14 and looking in the direction of the arrows.

As possibly best seen in FIGS. 14 and 15, the axially opposite ends of cylindrical members 106 and 108 are also formed provided with respective annular axial extensions 170 and 172. Cylindrical member 104, FIGS. 6 and 7, also has its end, which is axially opposite to 158, formed or provided with an annular portion axially extending in a direction opposite to that of annular or ring-like portion 158.

Figure 16:
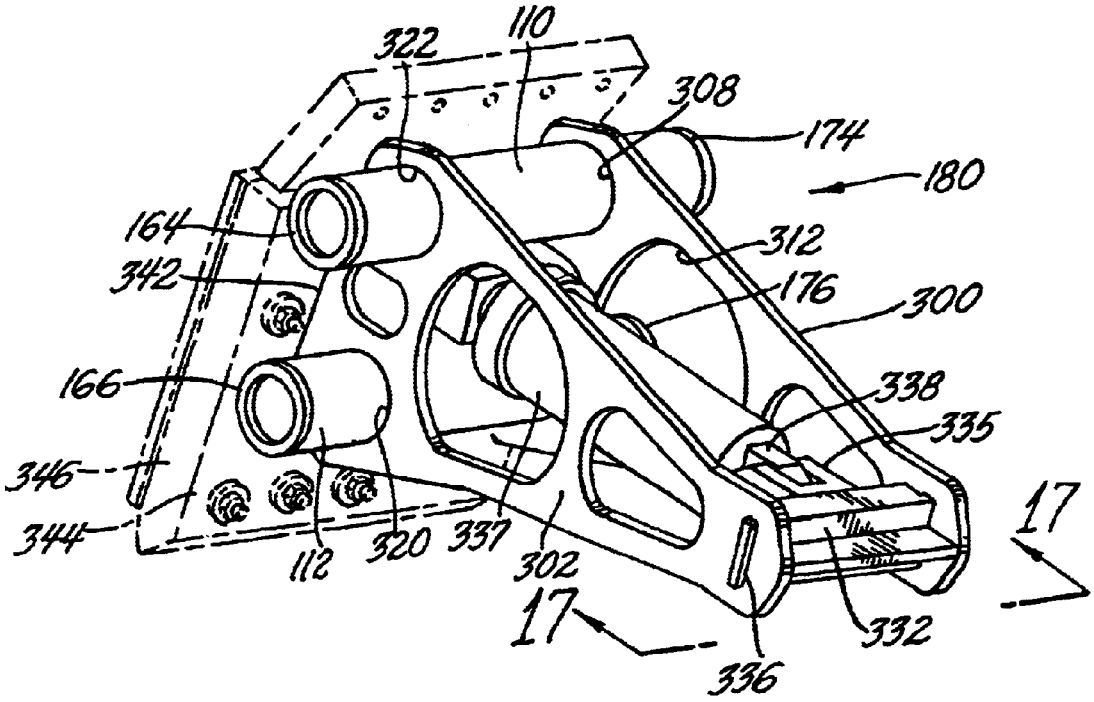
FIG. 16 is a perspective view of the left hand and right hand main cylinder plates assembled to the main cylinder assembly and showing the left hand and right hand main cylinder plates operatively connected to two coacting cylindrical members.
Figure 17:
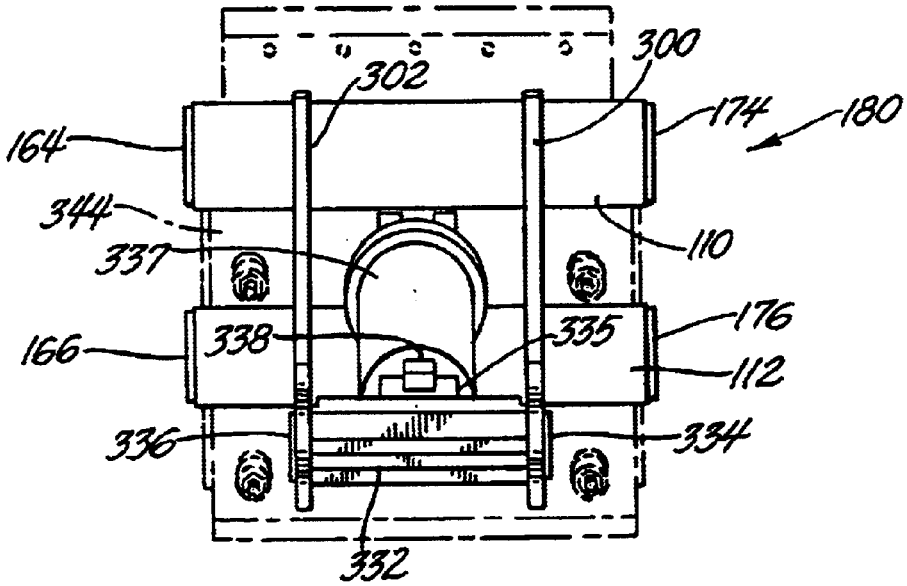
FIG. 17 is a view taken generally on the plane of line 17—17 of FIG. 16 and looking in the direction of the arrows.

As possibly best seen in FIGS. 16 and 17, the axially opposite ends of cylindrical members 110 and 112 are also formed or provided with respective annular extensions 174 and 176. Cylindrical member 110, FIGS. 16 and 17, also has its end, which is axially opposite to 164, formed or provided with an annular portion axially extending in a direction opposite to that of annular or ring-like portion 164.

In assembly: (a) the ring-like or annular portion 172 of cylindrical member 108 (FIGS. 6, 7, 14 and 15) is received by counterbore 82 (FIG. 5); (c) the ring-like or annular portion of cylindrical member 104 which is axially opposite to annular portion 158 (FIGS. 2, 6 and 7) is received by counterbore 80 (FIG. 5); (d) the ring-like or annular portion 174 of cylindrical member 110 (FIGS. 6, 7, 16 and 17) is received by counterbore 86 (FIG. 5); (e) the ring-like or annular portion 176 of cylindrical member 112 (FIGS. 6, 7, 16 and 17) is received by counterbore 88 (FIG. 5); and (f) the ring-like or annular portion at the axial end of cylindrical member 114 opposite to annular portion 168 (FIGS. 6, 7, 16 and 17) is received by counterbore 90 (FIG. 5).

Similarly, referring in each instance to, for example, FIGS. 4, 6 and 7 and to either FIGS. 14 and 15, or FIGS. 16 and 17, the annular or circular-like axially extending end portions 158, 160 and 162, respectively of cylindrical members 104, 106 and 108 are received by respective counterbores 44, 46 and 48 while the annular or circular-like axially extending end portions 164, 166 and 168 of cylindrical members 110, 112 and 114 are received by counterbores 50, 52 and 54.

As generally depicted in FIGS. 1, 6, 7, 14, 15, 16 and 17, in the preferred embodiment the crushing and/or breaking apparatus 10 is comprised of a main cylinder and assembly 180 and a back cylinder and assembly 182. As possibly best depicted in FIGS. 7, 8, 9, 12, 13, 14, and 15, the back cylinder and assembly 182 is preferably comprised of back cylinder mounting plates or member 184 and 186.

Figure 8:
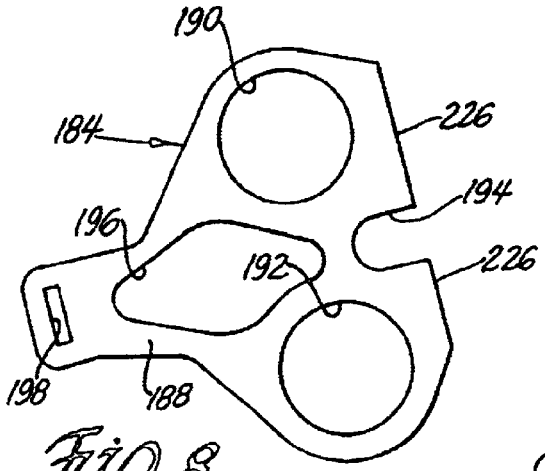
FIG. 8 is a side elevational view of the left hand back cylinder mounting plate which is also shown in FIGS. 1, 2, 6 and 7.

In FIG. 8, the plate member 184 is shown as comprising a body 188 through which are formed cylindrical apertures or passages 190 and 192, an open ended slot 194, a clearance aperture 196 and an elongated slot 198. Similarly, plate member 186, having a body 200, has cylindrical apertures or passages 202 and 204, an open ended slot 206, a clearance aperture 208 and an elongated slot 210.

As shown in FIGS. 6, 7, 14 and 15, an anchoring like member 212 has its ends 214 and 216 respectively received in slots 198 and 210. Member 212 also carries a yoke means 218 (FIG. 14) to which the back cylinder 220 is operatively connected as by a tab-like extension 222 and pivot member 224. Side plate member 184 is provided with a straight flat end surface 226 and, similarly, side plate member 186 is provided with a straight flat end surface 228.

Figure 12:
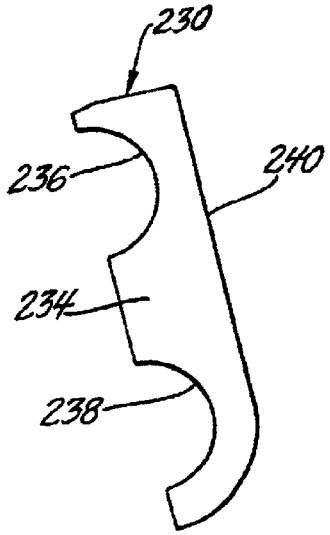
FIG. 12 is a side elevational view of the left hand back cylinder stop plate or member which is also shown at least in FIG. 7.
Figure 13:
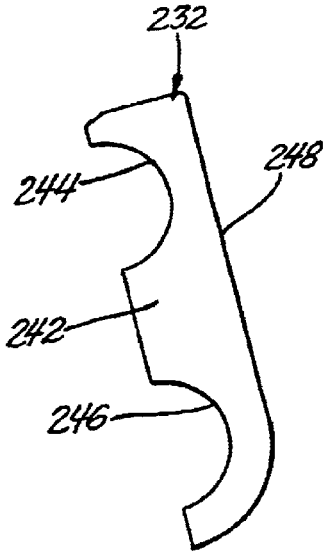
FIG. 13 is a side elevational view of the right hand back cylinder stop plate or member which is also shown in at least FIGS. 6, 7, 14 and 15.

FIGS. 12 and 13 illustrate a pair of back plate stops or stop members 230 and 232. The stop member 230 comprises a body 234 having spaced partial cylindrical surfaces 236 and 238 formed therein and a straight flat surface 240. Similarly, stop member 232 comprises a body 242 having spaced partial cylindrical surfaces 244 and 246 formed therein and a straight flat surface.

As best depicted possibly in FIGS. 7, 8, 9, 12, 13, 14 and 15, in the preferred embodiment apertures or passages 190 and 202 are effective to operatively engage cylindrical member 106 and maintain the relative depicted positions thereof. Similarly, apertures or passages 192 and 204 operatively engage cylindrical member 108 and maintain the relative depicted positions thereof.

As best depicted possibly in FIGS. 6, 7, 14 and 15, the member 212 is situated generally between plates or members 184 and 186 in a manner whereby a main body portion 212 in effect establishes the distance between plates 184 and 186 while ends 214 and 216 of body means 212 extend respectively through slots 198 and 210 of plates 184 and 186.

As shown in FIGS. 2, 6, 7, 12, 13, 14 and 15, in the assembled condition the back cylinder stop plates or members 230 and 232 are respectively carried by and secured, as by welding, to both cylinder members 106 and 108. That is, cylindrical surfaces 244 and 246 are operatively welded to cylinders 106 and 108 in a generally outboard location while cylindrical surfaces 236 and 238 are operatively welded to cylinders 106 and 108 in a generally outboard location opposite to member 234.

The abutting surfaces 240 and 248 of plates 230 and 232 are in general planar alignment with edges or surfaces 226 and 228 thereby providing sufficient means functioning as a stop for the plate or body 250 of the back blade assembly 182.

Figure 18:
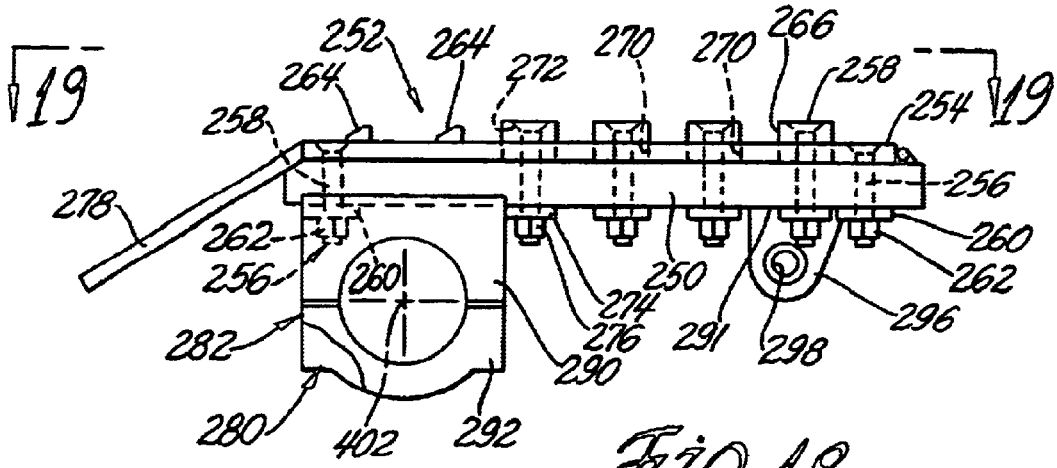
FIG. 18 is a side view of the back blade assembly which is also shown in at least FIGS. 1, 6 and 7.
Figure 19:
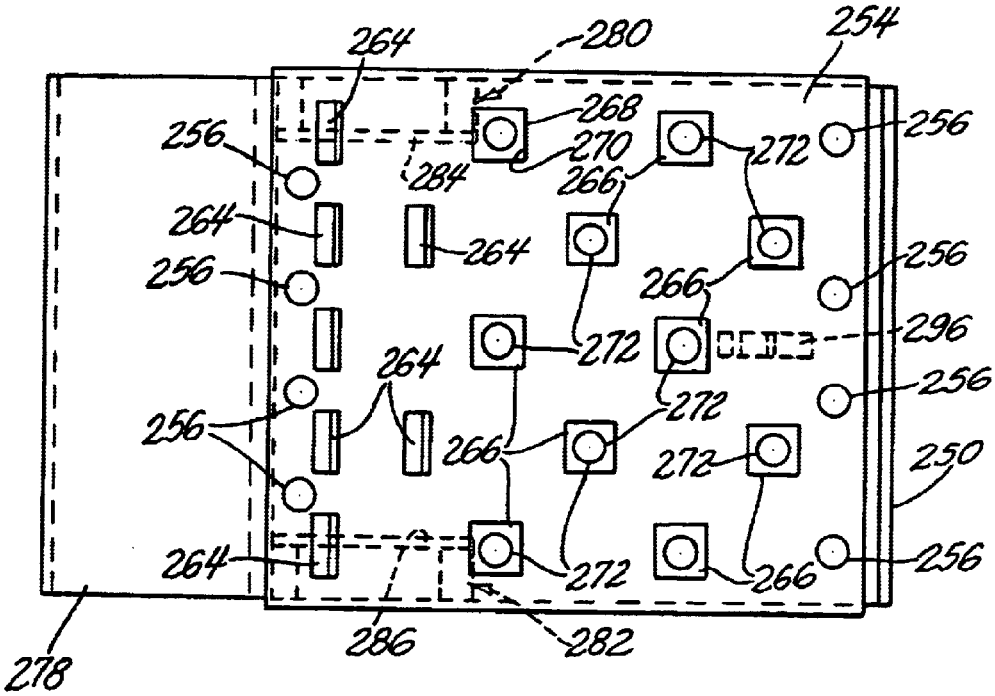
FIG. 19 is a view taken generally on the plane of line 19—19 of FIG. 18 and looking in the direction of the arrows.

FIGS. 18 and 19 illustrate, in greater detail, the back plate assembly 252 as preferably comprising a back plate 250 which, in turn, carries a face plate like member or wear plate 254. The back plate 250 and the wear plate member 254 may be suitably secured to each other as by a plurality of fastener means 256 comprised of bolts 258, washer means 260 and coacting nuts 262.

A first plurality of teeth 264 are secured to the wear plate 254 as by welding and a second plurality of teeth 266 are preferably removably secured to the back blade member 250. Each of the teeth 266 is depicted as comprising a tooth body 268 which, in the preferred embodiment, is received by a matching passage 270 formed in wear plate 254. Such teeth 266 are secured in the assembly 252 as by cooperating bolts 272, washers 274 and nuts 276.

A deflector body or shield 278 is suitably secured to the assembly 252 as, for example, by it being welded to the back plate or blade member 250.

As shown in, for example, FIGS. 1, 2, 6, 7, 18 and 19, in the preferred embodiment, bearing means 280 and 282 are operatively secured to the back blade 250. Preferably, mounting surfaces 284 and 286 are carried by the back blade 250 (FIGS. 6, 7, 14, 15, 18 and 19) for respectively mounting thereon bearing means or assemblies 280 and 282 securing such to back blade 250. That is, the base 288 (FIG. 6) of bearing assembly 280 is suitably secured to mounting 284. Similarly, the base 290 of bearing assembly 282 is suitably secured to mounting surface 286. Bearing cap 292 is operatively secured to bearing base 290 while a bearing 294 is operatively secured to bearing base 288. As should be apparent, especially in view of FIGS. 1, 6 and 7, bearing assemblies 280 and 282 enable the back plate assembly 252 to be pivotally moved about the axis 402 of cylinder or roller 104.

As also shown in at least FIGS. 18 and 19, a tab or connecting arm or link 296 is fixedly secured as to the depicted underside of back plate 250 and has an aperture or passage 298 for operative connection to the hydraulic cylinder means 220 as by cylinder rod 299 and interconnecting pivot pin 301 (FIGS. 6, 14 and 15).

As was previously stated, the abutment members or plates 230 and 232 are each suitably fixedly secured to the cylinders 106 and 108. The back plate 250 is pivotally swingable about the axis 402. The movement of the back plate assembly 252 in the clockwise direction, as viewed in FIGS. 14 and 18 is limited in that maximum clockwise movement is determined by abutments 230 and 232 engaging the back plate 250. That is, further motion is prevented when surface 240 of abutment 230 and surface 248 of abutment 232 operatively engage the juxtaposed surface 291 of member 250. When such abutting engagement is achieved, end surfaces 226 of member 184 and end surfaces 228 of member 186 are also in abutting engagement with back plates 250.

As possibly best depicted in FIGS. 6, 7, 10, 11, 16 and 17 the main cylinder and assembly 180 is preferably comprised of main cylinder mounting plates or members 300 and 302.

Figure 10:
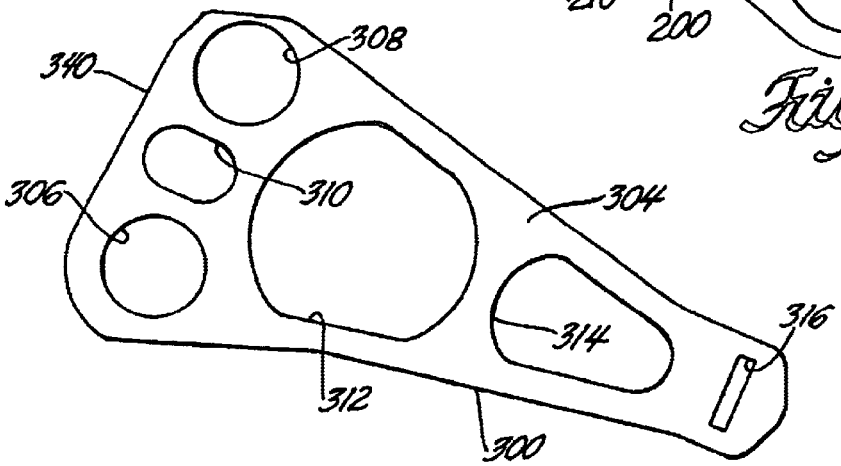
FIG. 10 is a side elevational view of the left hand main cylinder mounting plate which is also shown in FIGS. 6 and 7.
Figure 11:
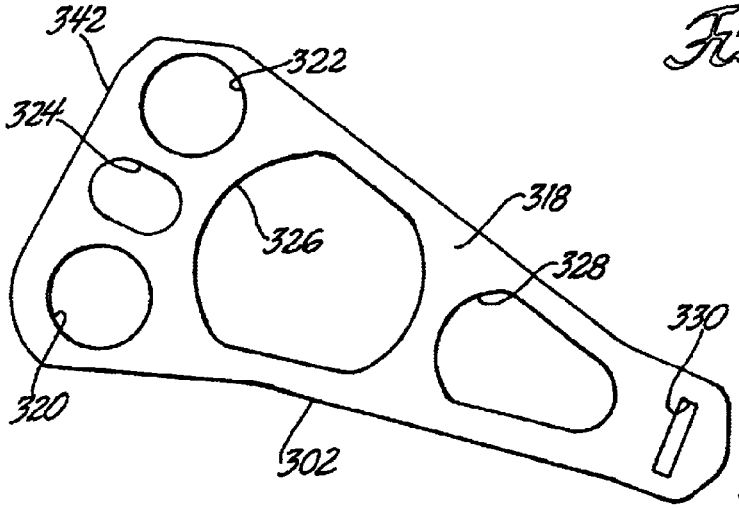
FIG. 11 is a side elevational view of the right hand main cylinder mounting plate which is also shown in FIGS. 1, 6 and 7.

In FIG. 10, the plate member 300 is shown as comprising a body 304 through which are formed cylindrical apertures or passages 306 and 308, a bean slot opening or passage 310, clearance apertures 312 and 314 and an elongated slot 316. Similarly, plate member 302, having a body 318, has cylindrical apertures or passages 320 and 322, a bean slot 324, clearance apertures 326 and 328 and an elongated slot 330.

As shown in FIGS. 6, 16 and 17, an anchoring like member 332 has end portions 334 and 336 respectively received in slots 316 and 330. Member 332 also carries a yoke like portion 335 to which the main cylinder 337 is operatively connected as by a tab-like extension 338 along with a pivot member 339 operatively joining the yoke 335 to the tab-like extension 338. Preferably, side plates 300 and 302 are respectively provided with straight flat end surfaces 340 and 342. Such surfaces 340 and 342 are preferably coplanar and parallel to the juxtaposed surface 344 of the main plate 346.

As best depicted possibly in FIGS. 10, 11, 16 and 17, in the preferred embodiment apertures or passages 322 and 308 are effective to operatively engage cylindrical member 110 and maintain the relative depicted positions thereof. Similarly, apertures or passages 320 and 306 are effective to operatively engage cylindrical member 110 and maintain the relative depicted positions thereof. As will be seen the opposite end of the main cylinder assembly 337, i.e., its piston rod 333, is operatively connected to the main plate 346 as by a tab or arm 392 of plate body 346 and connecting pivot pin 404.

Figure 20:
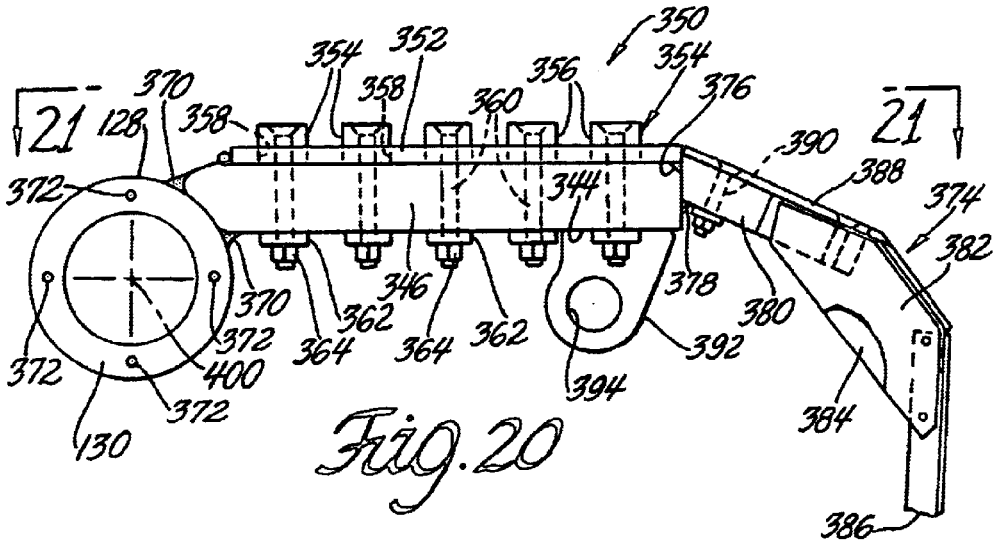
FIG. 20 is a side view of the main blade assembly which is also shown in at least FIGS. 6, 7, 22 and 23.
Figure 21:
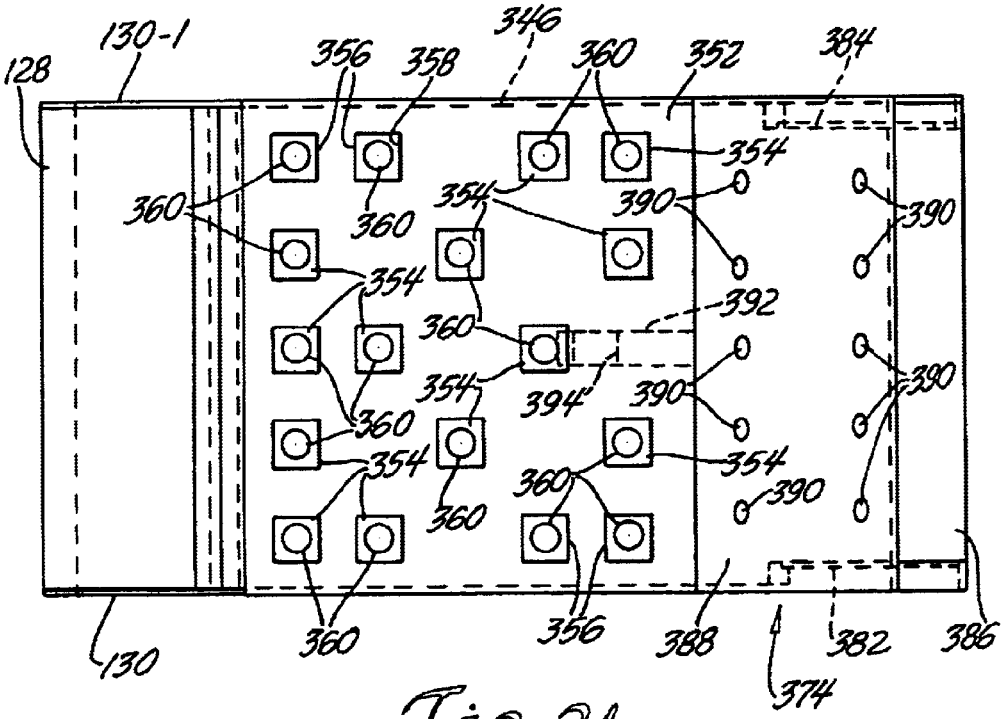
FIG. 21 is a view taken generally on the plane of line 21—21 of FIG. 20 and looking in the direction of the arrows.

FIGS. 20 and 21 illustrate in greater detail, the main plate or blade assembly 350 as preferably comprising the main blade body 346 which, in turn, carries a main face plate like member or wear plate 352. The main body 346 and the wear plate member 352 are suitably secured to each other as by welding or by the use of a plurality of fastener means as, for example, depicted at 256 of FIGS. 18 and 19.

A plurality of tooth-like members 354 are preferably removably secured to the main blade member 346. Each of the teeth 354 is depicted as comprising a tooth body 356 which, in the preferred embodiment, is received by a matching passage 358 formed in wear plate 352. Such teeth 354 are secured in the assembly 350 as by cooperating bolts 360, washers 362 and nuts 364.

The relatively larger roller or cylindrical member 130, as previously disclosed in FIGS. 6 and 7, and as depicted in the left hand portion of FIGS. 20 and 21 is secured to the blade member 346, preferably, by welding as at 370. Each end of cylindrical member 128 is preferably provided with a generally tapered bearing surface, as at 136 of FIG. 7, for securing thereagainst a bearing or journal portion as typically depicted at 132 of FIG. 7. Further, the respective ends 130 and 130-1 of the member 128 may be provided with suitable threaded holes 372 as depicted by way of example, in FIG. 20 (the actual number of such may be less or greater than that depicted) as to receive bolt-like members passing through member 134 (FIG. 7) and drawing that axially against the ends, and more particularly against the journal surface 136. This would occur at both ends 130 and 130-1 of member 128.

The opposite end of blade member 346 has a deflector or shielding means 374 which may be secured to blade member 346 as by welding depicted at 376 and 378. The deflector means 374 is shown as comprising a main body 380 to which at opposite ends thereof are secured carrying or supporting members 382 and 384 extending generally away and, in turn, supporting yet another deflector body or shield 386. A plurality of threaded fasteners are generally designated at 390 as serving to secure a wear plate 388 to the body 380.

As further shown in FIGS. 20 and 21, the underside (as shown in FIGS. 20 and 21) 344 of blade member 346 carries an extension portion or arm 392 with an aperture or passage 394 formed therethrough.

In the preferred embodiment, safety type covers 500 and 502 are provided, as generally depicted in FIGS. 1, 2, 6 and 22–27 with cover 500 being operatively secured, as by suitable fasteners, to members 184 and 186 and with cover 502 being operatively secured, as by suitable fasteners, to members 300 and 302. Other covers 503 may be respectively secured to walls or plates 14 and 16 as typically depicted in FIGS. 1 and 22.

The crusher 10 of the invention is also preferably provided with skirting means 504 and 506 respectively carried by and secured to walls 14 and 16. As possibly best shown in FIGS. 1, 2 and 6, each of skirting means 506 and 504 is shown as typically comprised of a top or upper rail like portion 508 and an inner plate 510 with upwardly extending support members 512, 514, 516 and 518 which at their respective lower ends 520 are secured to the outer walls 14 and 16. When assembled, the skirting means 504 and 506 preferably have a lower edge 522 of the inner plate 510 operatively juxtaposed to and above the respective upper ends of side walls 14 and 16.

It is also contemplated that side wear plates may be provided as at 523 and 524 (respectively inside of side walls 14 and 16) and secured to the walls 14 and 16 as by first bolts passing through passages 56, 58, 60 and 62 and aligned passages in wear plate 523 and by second bolts passing through passages 94, 96, 98 and 100 and aligned passages in wear plate 524.

Further, referring to FIGS. 1, 3, 6 and 7, the mounting or base plate or member 18 has an aperture 526 formed therethrough. Such aperture is, in effect, the discharge passage of the crusher or breaker 10. The portions of the plate 18 at opposite sides of the aperture 526 are provided with shed plates 528 (FIG. 6) and 530 assuring all broken and/or crushed material to be guided to and through passage or opening 526.

Operation of Invention

As generally depicted in FIGS. 1, 4 and 5, the axis 400, shown there, is also the axis 400 of FIGS. 6, 7, 20 and 23. Similarly, axis 402 as in FIGS. 1, 4 and 5 is also the axis 402 of FIGS. 18, 20 and 23. Since the bearing blocks 280 and 282 rotate about axis 402, any movement or motion of the back plate or blade assembly 252 will occur about axis 402. Likewise, since tubular member 128 is pivotally rotatable on the end journal supports 132—132 and since the front or main plate or blade assembly 350 is fixedly secured to tubular member 128 for rotation therewith, any motion of the front or main blade assembly will occur about axis 400.

Figure 22:
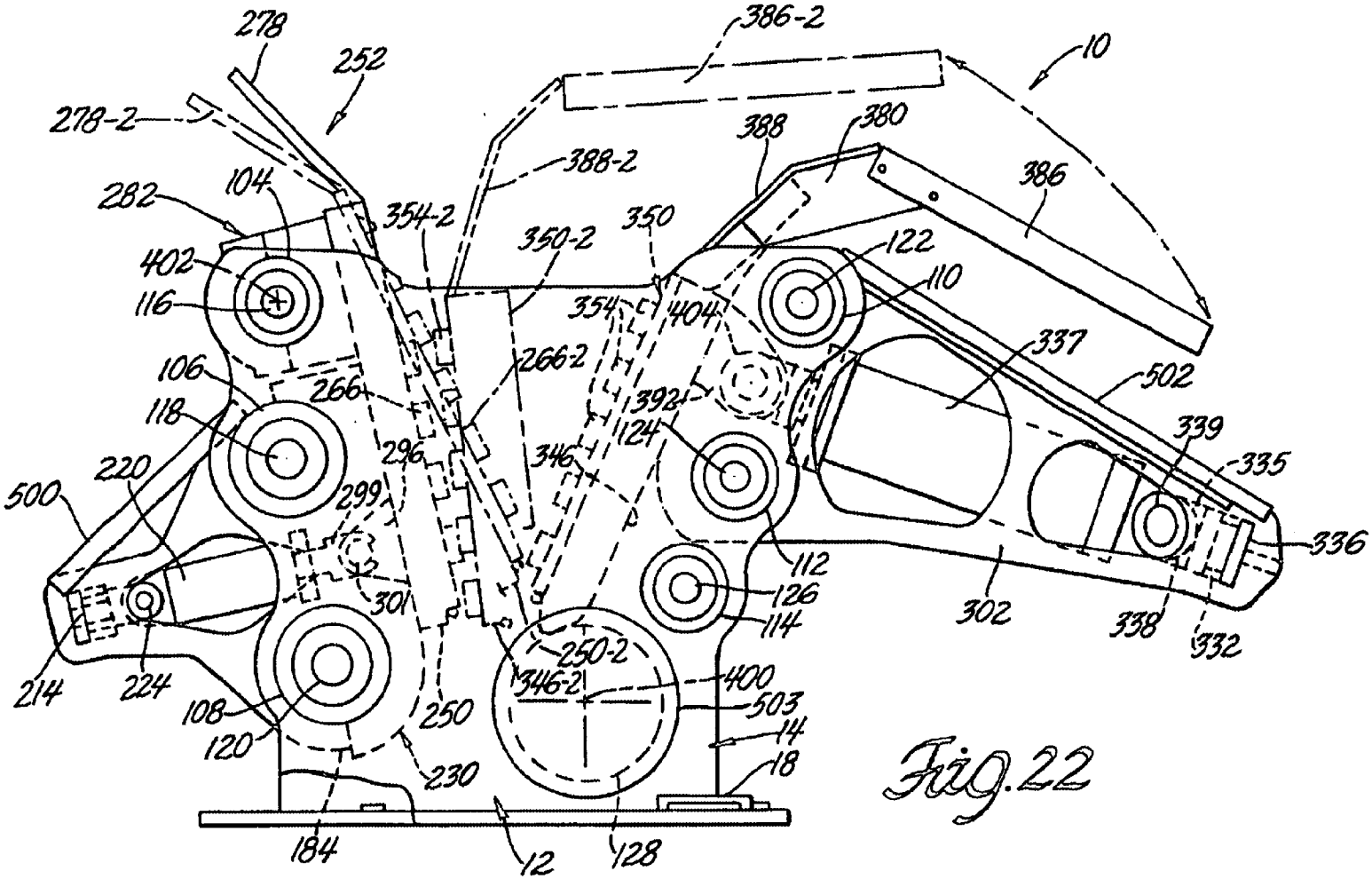
FIG. 22 generally represents the right side view of the assembly of FIG. 1 and with many of the elements and details comprising such assembly not being shown for clarity of disclosure.
Figure 23:
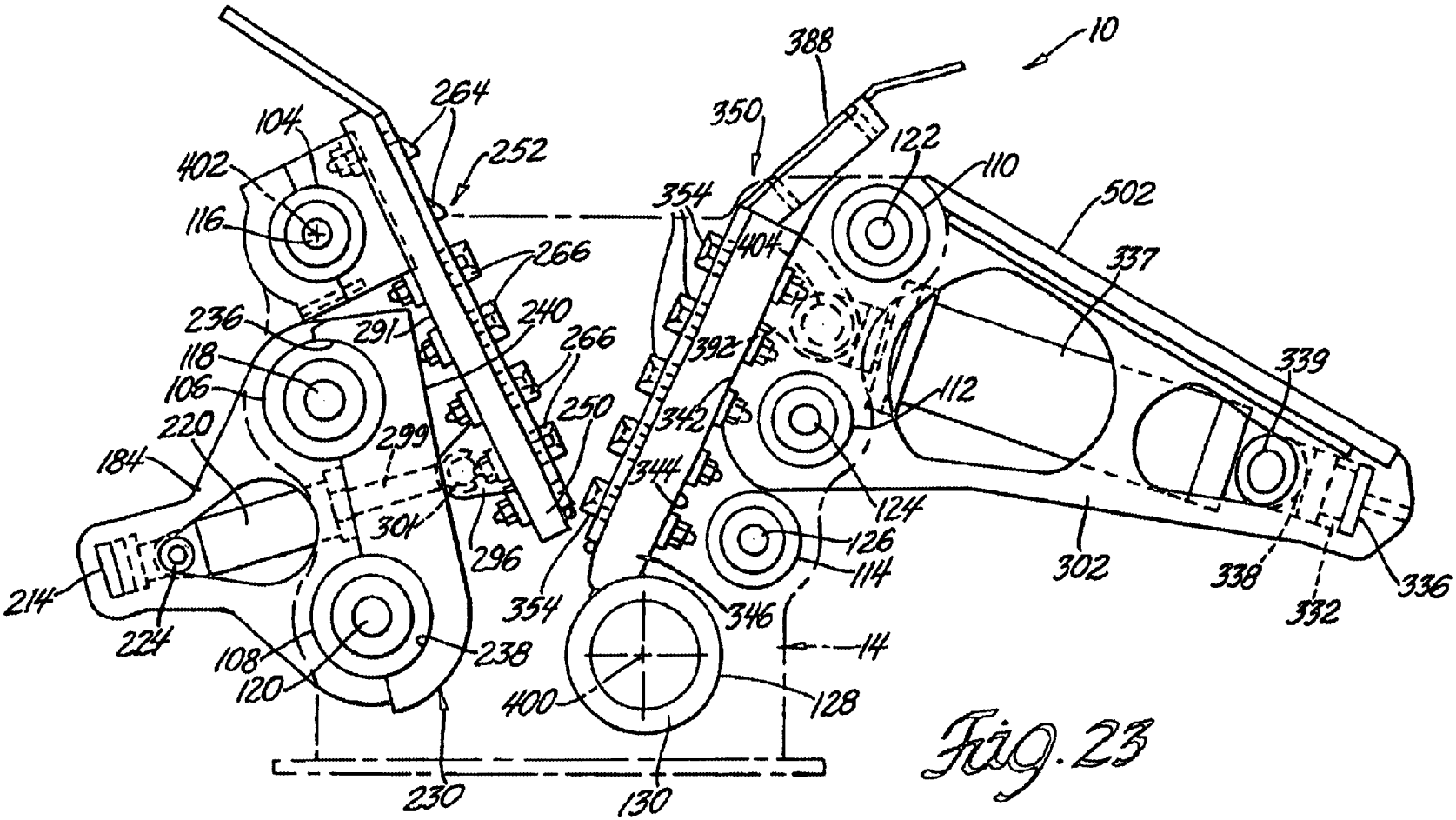
FIG. 23, a view similar to FIG. 22, illustrates the general positions of the back assemblies at what may be considered a starting position for the structure of FIG. 1.

FIGS. 22 and 23 may be considered as generally representing the right side view of the assembly 10 of FIG. 1 but with many of the elements and details comprising such assembly 10 not being shown for ease and clarity of description.

FIG. 22 illustrates a generally composite view of the extremes, in positions, which the back blade may experience with such being designated 250 and 250-2. Also it provides a generally composite view of the extremes, in positions, which the main blade may experience with such being designated 350 and 350-2.

FIG. 23, illustrates the general positions of the back blade assembly 252 and of the front or main blade assembly 350 at what may be considered a starting position for the crusher 10 as at the start of loading material, to be crushed or broken, generally into the space between the depicted blade assemblies 252 and 350.

An inspection of FIG. 23 will show that the main blade assembly 350 may remain against, or be slightly spaced away from, end surface 342 (and end surface 340 FIGS. 10 and 16) while the back blade assembly 252 has undergone counter-clockwise rotation about axis 402 to the generally depicted position wherein the lower most portion of blade member 250 is in contact (or at least close to being in contact) with main blade assembly 350. In any event whatever space may exist between the lower juxtaposed portions of blade members 250 and 346, such space is not sufficient to permit the material (to be crushed) to freely pass therethrough.

It should be apparent that the cutlery projections or bodies 354 of main plate assembly 350 are positioned as to be offset relative to the bodies or cutlery projections 266 of back blade assembly 252. That is, if assemblies 252 and 350 were to be moved relatively toward reach other, such movement would not be stopped by cutlery projections 266 engaging cutlery projections or bodies 354. The cutlery projections 266 and remainder of the back blade assembly 252 may be considered a first cutlery device while the cutlery projections 354 and remainder of the front or main blade assembly 350 may be considered a second cutlery device.

Figure 24:
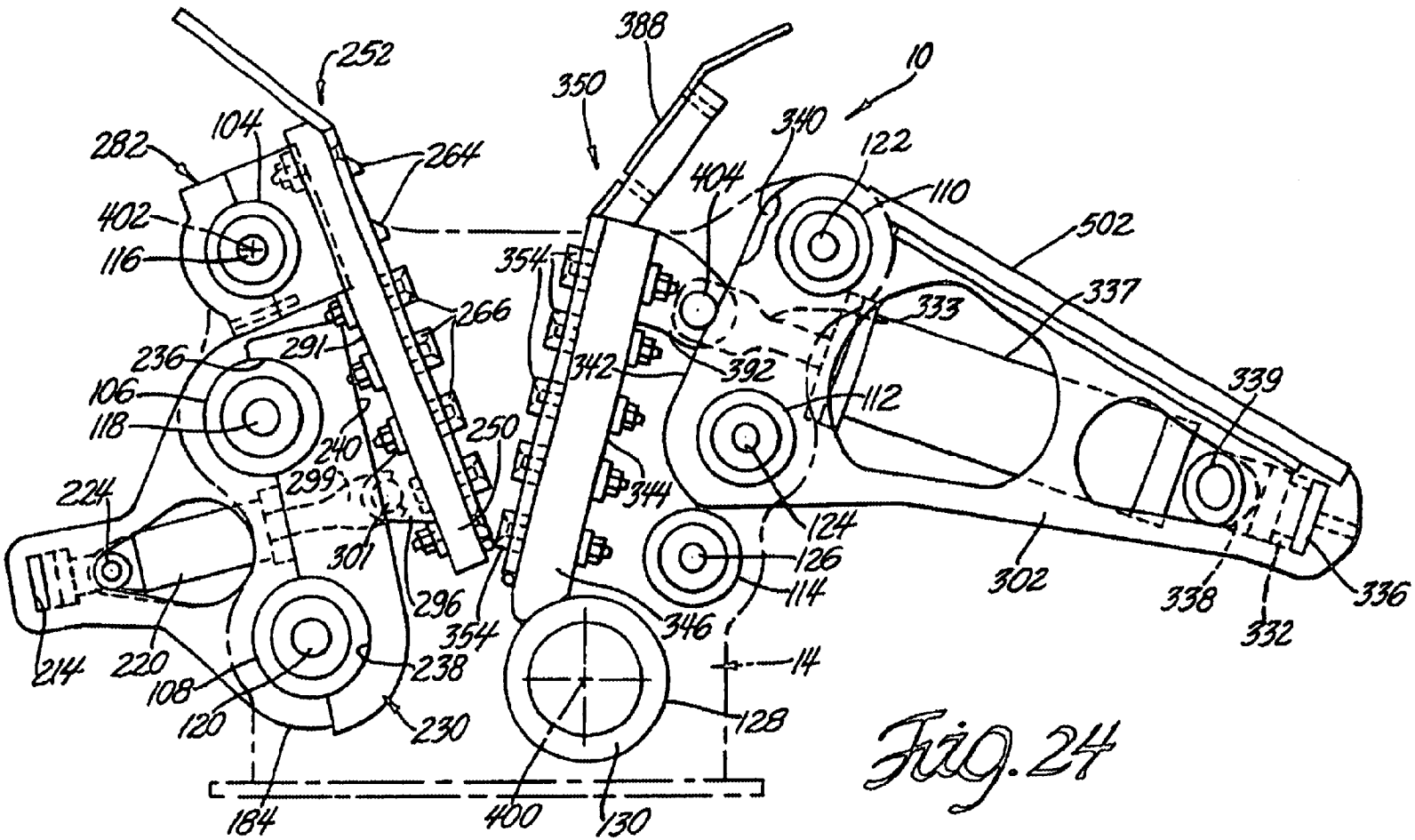
FIG. 24 is a view similar to FIGS. 22 and 23 but showing the back and main blade assemblies in positions different from that shown in FIG. 23.

FIG. 24 illustrates the general positions of the back blade assembly (first cutlery device) 252 and the front or main blade assembly (second cutlery device) 350 at or passing through a particular stage of operation.

In comparing FIGS. 23 and 24, it will be seen that the main blade assembly 350 has been pivotally rotated, by the piston rod 333 of piston assembly 337, some amount counter-clockwise about axis 400. Such rotation of the main blade assembly (second cutlery device) 350, in turn, causes the back blade assembly (first cutlery device) 252 to move some amount clockwise about the axis 402. The clockwise movement of blade assembly 252 is brought about by piston means 337 urging the main blade assembly 350 toward back blade assembly 252. This occurs either by actual contact between the back blade and main blade assemblies 252 and 350, or by the main blade assembly moving against the material (to be crushed or broken) between blade assemblies 252 and 350 and through such material causing the back blade assembly 252 to pivot about axis 402 and move to, for example, the depicted position.

In comparing the views of FIGS. 23 and 24, it can be seen that in FIG. 24 the main blade assembly 350 has moved away from stop surface 342 (and stop surface 340 of FIG. 10) while the back blade assembly 252 has pivoted about axis 402 and moved closer to having end surfaces 226 and 228, of plates 184 and 186, and abutment end surfaces 240 and 248 of plates 230 and 232 operatively abut against surface 291 of plate member 250 which would stop further clockwise rotation of back plate assembly 252.

Figure 25:
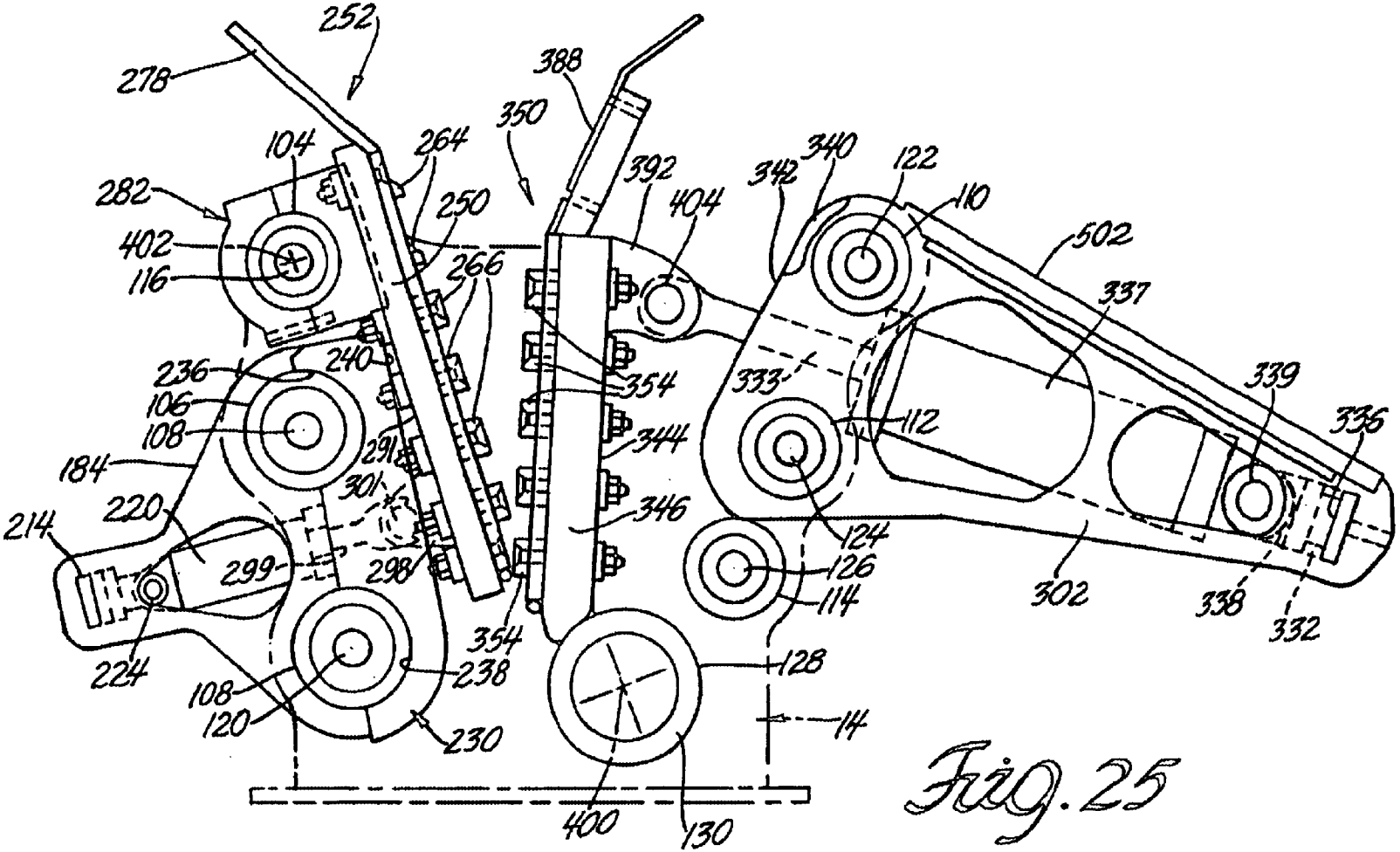
FIG. 25 is a view similar to FIGS. 23 and 24 but showing the back and main blade assemblies in positions different from that shown in FIG. 24.

FIG. 25 illustrates the general positions of the back blade assembly (first cutlery device) 252 and the front or main blade assembly (second cutlery device) 350.

In comparing FIGS. 24 and 25, it will be seen that the main blade assembly 350 has been further pivotally rotated, by the piston rod 333 of piston assembly 337, some amount counter-clockwise about axis 400. Such rotation of the main blade assembly (second cutlery device) 350, in turn, causes the back blade assembly (first cutlery device) 252 to move some amount clockwise about the axis 402. The clockwise movement of blade assembly 252 is brought about by piston means 337 urging the main blade assembly 350 further toward back blade assembly 252. This occurs either by actual contact between the back blade and main blade assemblies 252 and 350, or by the main blade assembly 350 moving against the material (to be crushed or broken) between blade assemblies 252 and 350 and through such material causing the back blade assembly 252 to pivot about axis 402 and move, for example, to the depicted position.

In comparing the views of FIGS. 24 and 25, it can be seen that in FIG. 25 the main blade assembly 350 has moved further away from stop surface 342 (and stop surface 340 of FIG. 10) while the back blade assembly 252 has further pivoted clockwise about axis 402 and moved still closer to having surface 291 of member 250 come into operative engagement with abutment or stop surfaces 240 and 248, of plates 230 and 232, and into abutting engagement with end surfaces 226 and 228, of plates 184 and 186.

Figure 26:
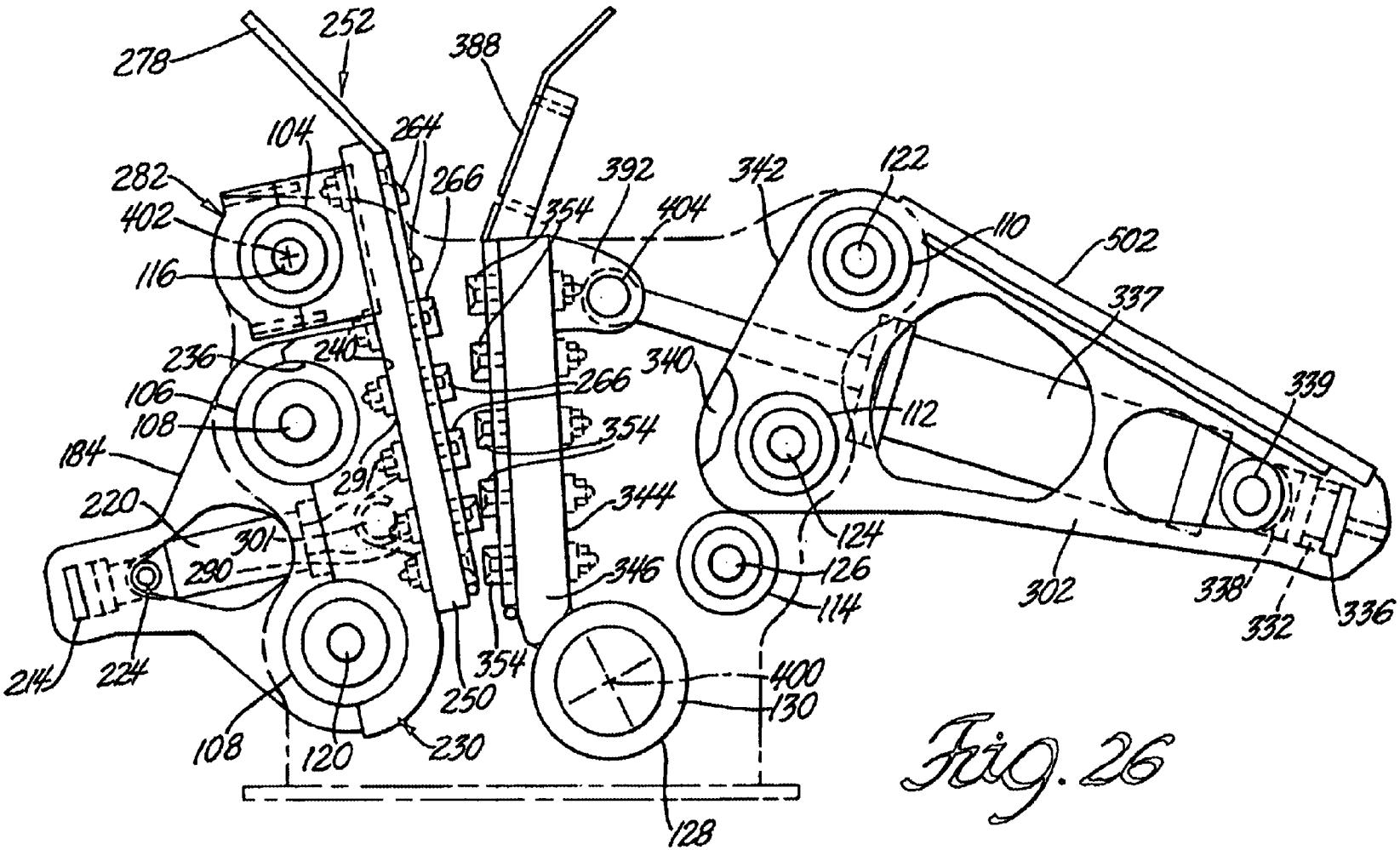
FIG. 26 is a view similar to FIG. 25 and showing the back and main blade assemblies generally depicting maximum crushing or breaking by the blade assemblies.

FIG. 26 illustrates the general positions of the back blade assembly (first cutlery device) 252 and the front or main blade assembly (second cutlery device) 350.

In comparing FIGS. 25 and 26, it will be seen that that the main blade assembly 3.50 has been further pivotally rotated, by the piston rod 333 of piston assembly 337, some amount counter-clockwise about axis 400. Such rotation of the main blade assembly (second cutlery device) 350, in turn, causes the back blade assembly (first cutlery device) 252 to move some amount clockwise about the axis 402. The clockwise movement of blade assembly 252 is brought about by piston means 337 urging the main blade assembly 350 toward back blade assembly 252, This occurs either by actual contact between the back blade and main blade assemblies 252 and 350, or by the main blade assembly 350 moving against the material (to be crushed or broken) between blade assemblies 252 and 350 and through such material causing the back blade assembly 252 to pivot about axis 402 and move, for example, to the depicted position.

Figure 9:
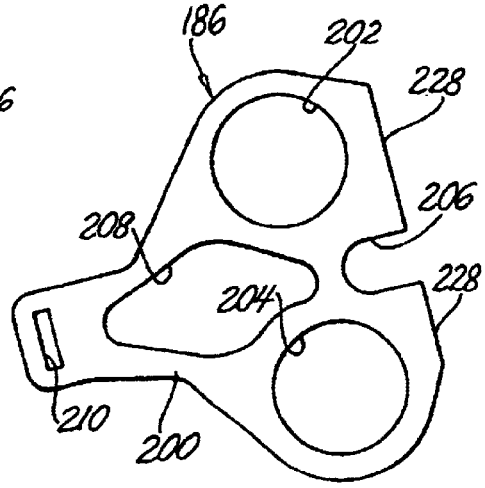
FIG. 9 is a side elevational view of the right hand back cylinder mounting plate which is also shown in FIGS. 1, 2, 6 and 7.

In comparing the views of FIGS. 25 and 26, it can be seen that in FIG. 26 the main blade assembly 350 has moved further away from stop surface 342 (and stop surface 340 of FIG. 10) while the back blade assembly 252 has further moved as to become against the fixed stops 230 and 232 (FIGS. 12 and 13) as well as against stop surfaces 226 and 228 (FIGS. 8 and 9).

Figure 27:
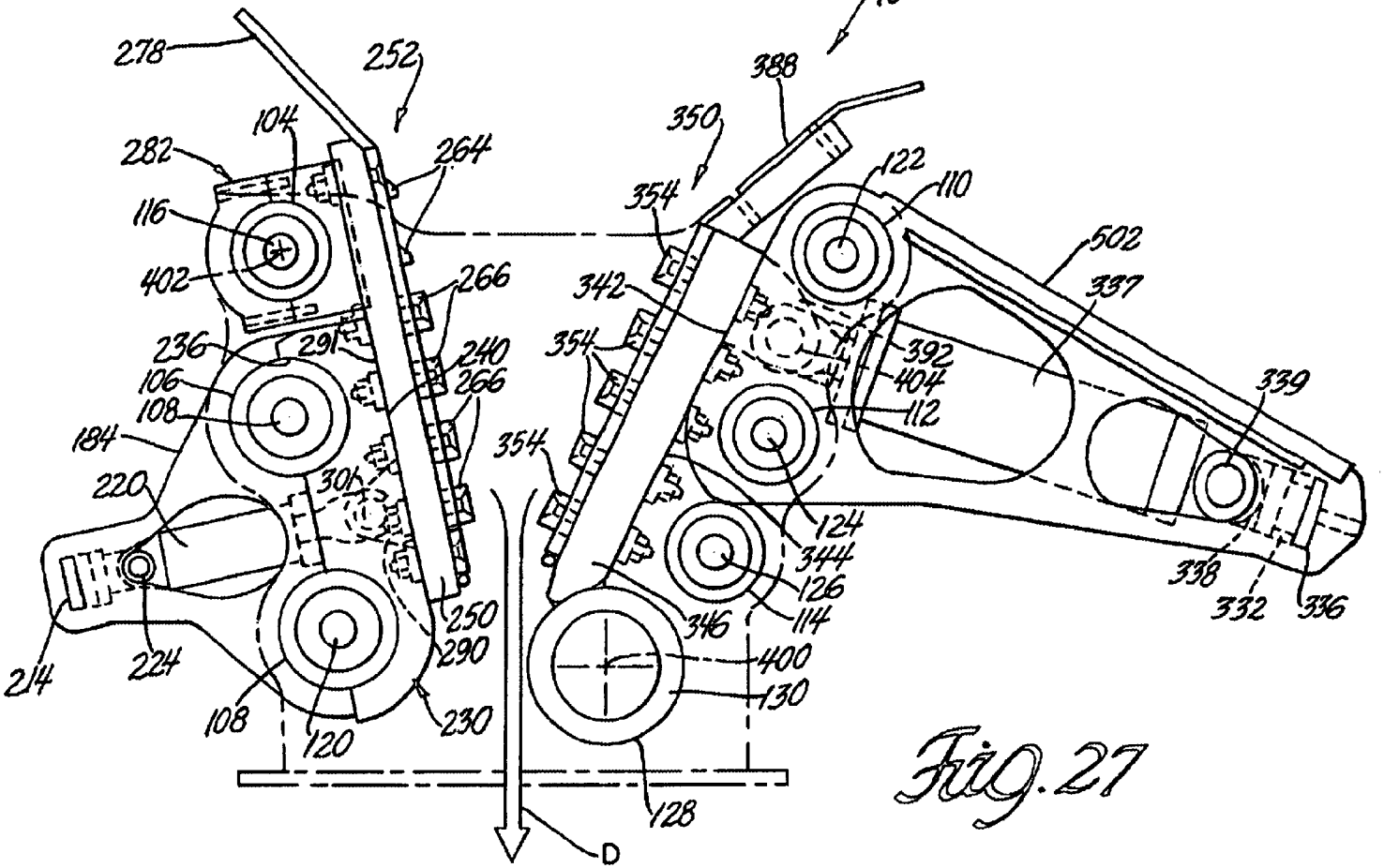
FIG. 27 is a view similar to FIG. 26 and showing the relative positions of the back and main blade assemblies as at time of dumping or discharging the crushed or broken work material.

FIG. 27 illustrates the general positions of the back blade assembly (first cutlery device) 252 and the front or main blade assembly (second cutlery device) 350.

In comparing FIGS. 26 and 27, it will be seen that the back blade assembly 252 preferably remains in its FIG. 26 position, i.e., against the cooperating abutment surfaces 240 and 248, of abutment members 230 and 232, and against abutment surfaces 340 and 342, of members 300 and 302, while the piston means 337 pivoted the main blade assembly 350 clockwise about axis 400 until its surface 344 operatively abutted against stop surface 342 (and stop surface 340 of FIG. 10).

This may be considered as the completion of a crushing and discharging cycle. That is; the back blade assembly 252 and the main blade assembly 350 are moved away from each other thereby providing an unrestricted flow of broken and crushed material as depicted by arrow D in FIG. 27. Such may also, in simplified form, represent the discharge or out-flow opening 526 of FIGS. 3, 6 and 7 discharging the completed work from the assembly 10.

When the next crushing or breaking cycle is to begin, the back blade 252 is first again positioned as generally depicted in FIG. 23. No repositioning of main blade assembly 350 would be necessary since its position then would already correspond to that as depicted in FIG. 23. However, it is also contemplated that at this stage of the next breaking and crushing cycle, the main blade assembly 350 could be initially rotated counter-clockwise as to be some relatively small distance away from coacting stop means 342 and 340.

In the preferred embodiment of the invention, the movement of the back blade assembly 252 and the movement of the front or main blade assembly 350 is hydraulically brought about. Accordingly, in the preferred embodiment, hydraulic cylinder assembly 220 serves to move back blade assembly 252 pivotally about axis 402 while hydraulic cylinder assembly 337 serves to move the main or front blade assembly 350.

Cylinder assembly 220 is provided with aperture or passage means 570 and 572 communicating with the interior of cylinder assembly 220 generally at opposite sides of piston means 574. The conduit portion 570 is operatively connected as via conduit means 576 to valving means 578 and, similarly, conduit portion 572 is also operatively connected via conduit means 580 to valving means 578.

A pump $P_1$ driven by a motor M receives hydraulic fluid, via conduit means 581, from a reservoir 582 and, under pressure, supplies such hydraulic fluid, via conduit means 584, to valving means 578.

The valving means 578 is actuated as by signals along transducer means 586 generated as by electronic control unit (ECU) 588. When the ECU actuates valving means 578 to a condition wherein conduit means 584 is placed into communication with conduit 576, the pump $P_1$ supplies hydraulic fluid, under pressure against the piston 574 as to urge piston 574 and piston rod 299 to the right (as viewed in FIG. 28). As this is occurring, the hydraulic fluid at the opposite side of piston 574 is forced out of the cylinder assembly 220 and through conduit means 580 into valving means 578 from where such fluid flows via conduit or passage means 590 to hydraulic sump 592.

In those situations wherein ECU 588 causes valving means 578 to move in an opposite direction, conduit 584 is placed in communication with conduit means 580 causing piston 574 to force hydraulic fluid out through passage means 570 and via conduit means 576, through valving means 578, and to sump 592 via conduit means 590.

As hydraulic fluid is applied via conduit means 576 and against piston 574, the piston rod 299 is caused to extend moving the piston rod 299 and the back blade assembly 252 to an extended position as generally depicted in FIG. 22, at 250-2, and as depicted at 250 of FIG. 23.

The valving means 600 is actuated as by signals along transducer means 614 generated as by the ECU 588. When the ECU 588 actuates valving means 600 to a condition wherein conduit means 608 is placed into communication with conduit 598, pump $P_2$ supplies hydraulic fluid under pressure against the piston 596 as to urge piston 596 and piston rod 333 to the left (as viewed in FIG. 28). As this is occurring, the hydraulic fluid at the opposite side of piston 596 is forced out of the cylinder assembly 337 and through conduit means 602 into valving means 600 from where such fluid flows via conduit or passage means 616 to hydraulic sump 618.

In those situations wherein ECU 588 causes valving means 610 to move in an opposite direction, conduit 608 is placed in communication with conduit 602 causing piston 596 to force hydraulic fluid out through passage means 594 and via means 598 through pressure sensor 610, through valving means 600, and to sump 618 via conduit means 616.

A pump $P_2$ driven by motor $M_2$ receives hydraulic fluid via conduit means 604 from a reservoir 606 and under pressure, such hydraulic fluid is pumped via conduit means 608 to valving means 600.

As generally depicted, in the preferred embodiment, as already shown, a pressure sensor or pressure signal generator 610 is operatively connected as to conduit means 598 so that the pressure in conduit means 598 is conveyed to the sensor-signal generator 610. When a preselected magnitude of pressure is sensed by sensing means 610 a related signal is applied to the ECU 588 via conductor means 612.

Such a pressure signal may then be employed as an indication that the crushing function is requiring hydraulic pressures above the magnitude that is desired. Such, then via transmission 612 conveys the signal to ECU 588 which, in turn, causes at least the main blade 350 to move some distance in the opening direction permitting the work to be crushed to re-arrange itself somewhat lower between blades 252 and 350 thereby enabling such work to be crushed within normal operating hydraulic pressure.

Figure 28:
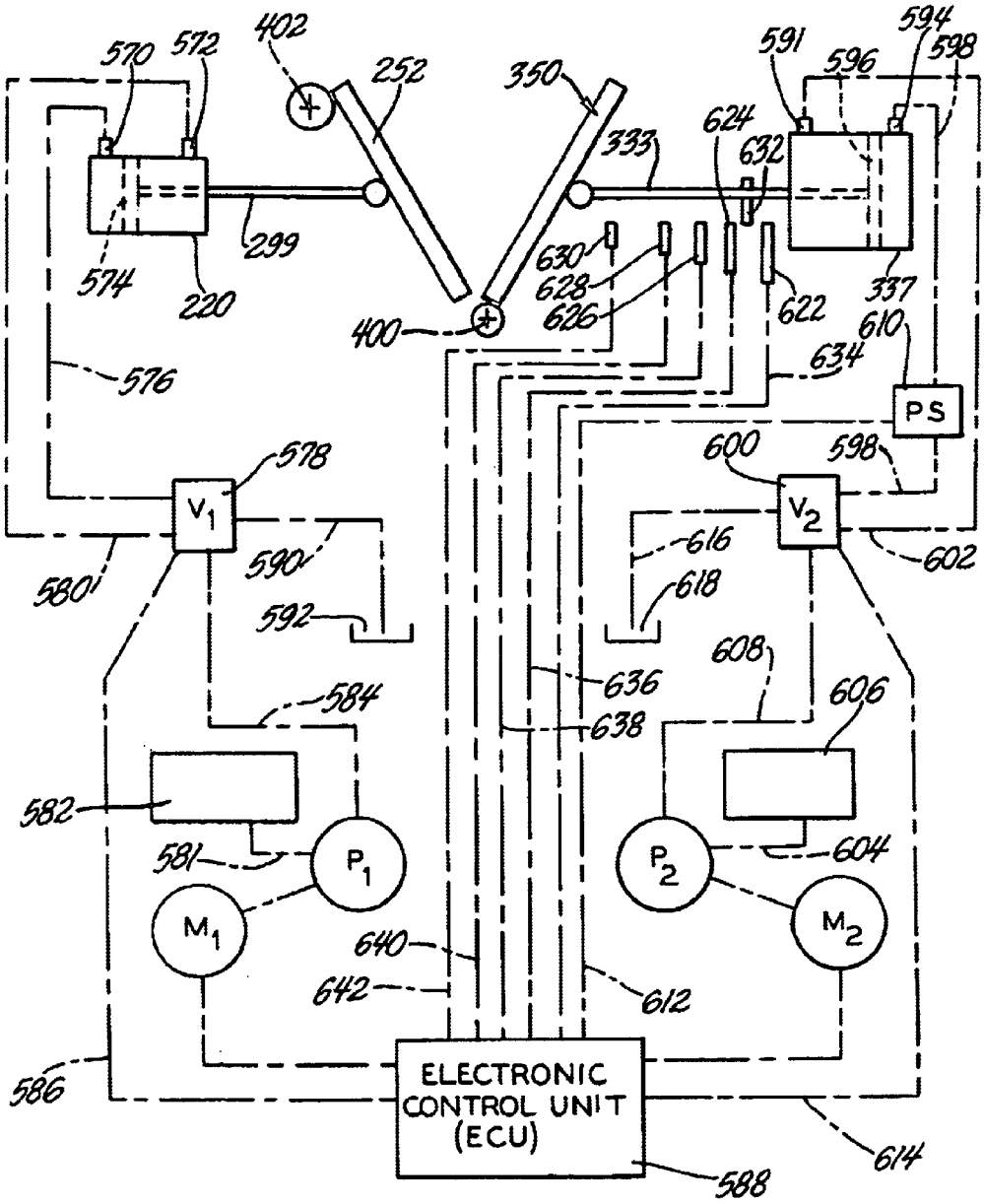
FIG. 28 is a generally simplified somewhat schematic and somewhat diagrammatic view of the invention including at least some operational and control members and means.

FIG. 28 also depicts what may be referred to as proximity switches 622, 624, 626, 628 and 630 positioned at selected locations as to thereby have an actuator 632, operatively carried as by the piston rod 333, be effective to operatively engage and actuate such proximate switch means to thereby send signals, respectively as along conductor means 634, 636, 638, 640 and 642 to the ECU 588. In the preferred embodiment, the actuator 632 effectively causes the proximity switch to continue being closed, for example, once the actuator 632 closes the switch and the actuator does not subsequently return past the proximity switch.

That is, for example, if piston 596 and rod 333 are moving to the left and actuator 632 operatively engages and closes switch means 624, it is preferred that such proximate switch means, as 624, remain in the actuated condition even though the piston rod 333 and actuator continue in movement towards and beyond switch means 630. In such an arrangement, the respective switch means 630, 628, 626 and 624 would sequentially become only as the actuator means reverses in its travel and passes the juxtaposed switch means in the actuator's travel toward assembly 337. The practice of the invention may comprise more or less of such proximate switch means.

Figure 29:
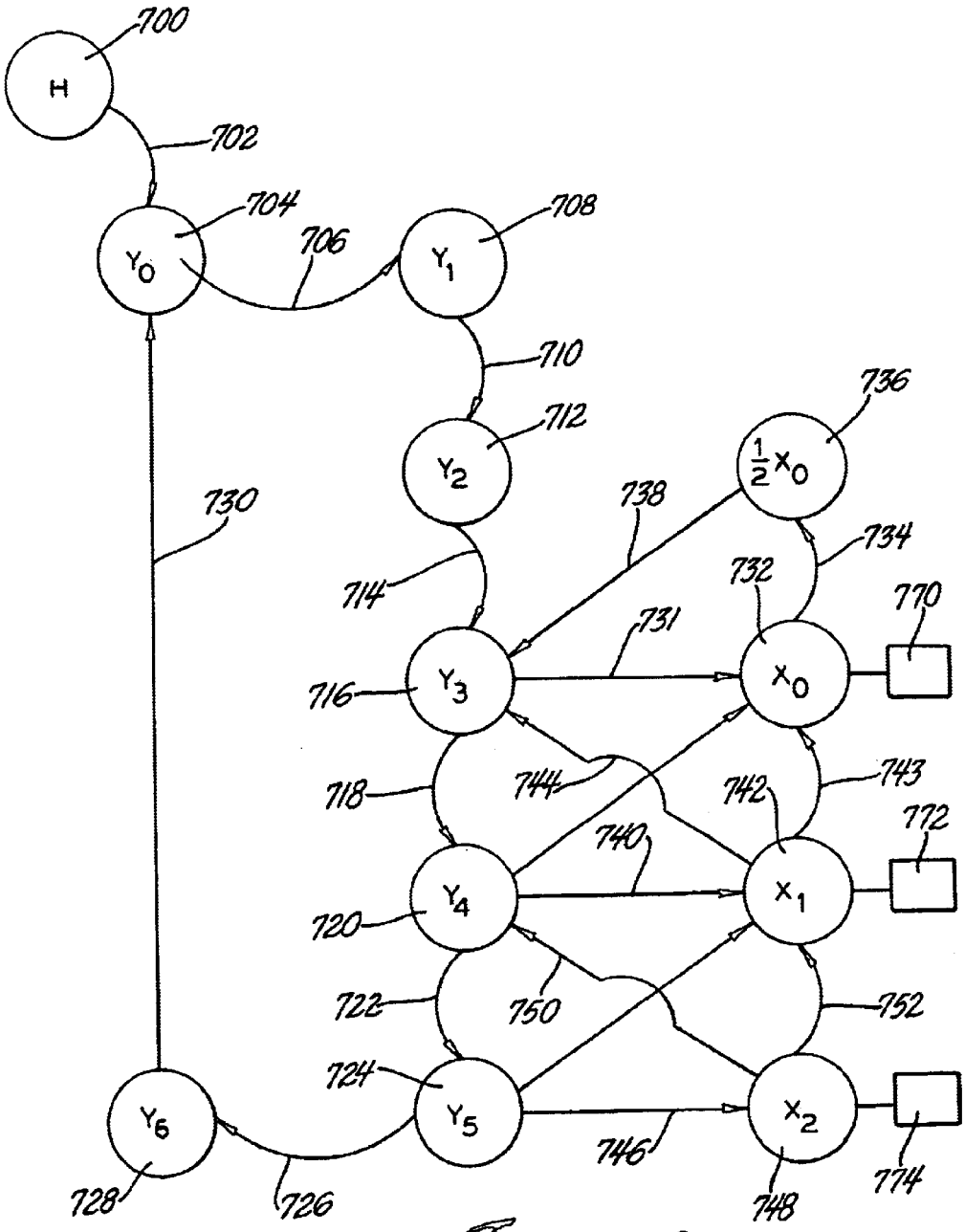
FIG. 29 may be considered as a flow chart of various stages of operation of the apparatus of the invention.

Referring now primarily to FIG. 29, the chart provided therein may be considered a flow chart of various stages which the apparatus of the invention may experience.

Respective states or stages are identified as a series of states $Y_0$ to $Y_6$ and as a series of states ½ $X_0$ to $X_2$. Such being done primarily to easily visually indicate respective progressions. The various states or stages are also identified by numbers for ease of discussion.

In FIG. 29 a home, H, position or condition is designated at 700 and such may be considered as being depicted in FIG. 27.

At 702 the apparatus 10 is undergoing movement resulting in condition or state 704 wherein the apparatus 10 has moved to where main blade assembly 350 is against its stops 342 and 340 and back blade assembly 252 has moved against its stops 240, 248, 226 and 228.

At 706 the main blade assembly 350 is preferably moving a slight amount away from its FIG. 27 position which is established at condition or state 708. From there, at 710, the back blade assembly 252 moves toward the state or condition 712.

When the apparatus 10 reaches condition or state 712 the back blade assembly 252 has reached its FIG. 23 depicted position and is ready as at 714 for an initial load of work to be placed generally between blade assemblies 252 and 350. When such work, to be crushed, is loaded (as at 714) state or stage 716 initiates the crushing or crunching of the work. This, of course, means that the main blade assembly 350 is moving against the work and toward the back blade assembly 252. Various sensing means and/or switches are preferably provided and used as means for indicating conditions being experienced by, or in, the apparatus 10 in its crushing or crunching portion of the overall cycle of operation. Among such sensing means and/or switches are proximate sensors, sensing means and/or switches as referred to and depicted in FIG. 29.

As crushing at 716 continues, as depicted at 718, and if the associated proximate switch becomes, in effect, engaged, then the crushing of the work continues thereby achieving or attaining state or stage 720.

Further, as the apparatus 10 continues in its crushing (main blade assembly 350 moving closer to back blade assembly 252), if the related proximate switch becomes, in effect, engaged then the crushing at 722 continues to the attainment of state or stage 724.

Having arrived at 724, if the related proximate switch means becomes, in effect, engaged then the operation of the apparatus 10 as indicated at 726 leads to condition or state 728.

At condition 728, signal or signals are generated indicating that all crushing has been completed causing the back blade assembly 252 and the main blade assembly 350 to undergo relative movement resulting in such blade assemblies becoming operatively opened, as generally depicted in FIG. 27, thereby discharging or dumping the crushed material out of the apparatus 10 as depicted or represented by arrow D of FIG. 27.

The apparatus 10 then proceeds in movement as along motion 730 wherein the back blade assembly 252 remains as against its coacting stops or abutments 226, 228, 240 and 248 while the main blade assembly 350 has moved to a position generally depicted in FIG. 23, against its coacting stops or abutments 340 and 342 or, as previously stated, a slight distance away from 340 and 342. The apparatus 10 then is again in condition to repeat the overall cycle.

In the preferred embodiment of the invention, the piston 596 is moved against the resistance offered by the work to be crushed. The amount of force produced by such piston is preferably set at a maximum selected magnitude considered sufficient for all normal operations. However, there will be instances wherein the application of such maximum selected magnitude is not sufficient to achieve the desired crushing function. This may be considered and referred to as an overpressure condition in that without other action, in order to achieve the desired crushing, an hydraulic overpressure would have to be supplied to piston means 596 which, cannot be done because a selected maximum magnitude of pressure has been established.

The invention achieves the desired result, i.e., crushing without having to supply hydraulic pressure in excess of said selected maximum magnitude. For ease of reference, such an experienced condition wherein the piston means 596 and the main blade assembly 350 are unable to crush, will be referred to as an overpressure condition.

The invention achieves the desired result, i.e., crushing without having to supply hydraulic pressure in excess of said selected maximum magnitude. The invention accomplishes that by causing the work (to be crushed) to be relocated as between the back blade assembly 252 and the main blade assembly 350. Such relocation is brought about by opening the blade assemblies and thereby causing or permitting the individual pieces, which comprise the load, to fall downwardly so that a greater mechanical advantage is achieved by the piston 596 (cylinder assembly 337) enabling the crushing function to be accomplished without applying an increased hydraulic pressure.

At transition 714 the apparatus 10 is approaching state 716. However, if at that time an overpressure condition is experienced, the apparatus 10, instead of achieving state 716, continues along transition 731 to state or condition 732 which comprises a first counting means 770 effective to count the times that apparatus 10 has experienced the state or condition 732. Apparatus 10 then transitions as at 734 to state or condition 736 and, as hereinbefore explained and described, the blade assemblies are relatively opened enabling pieces of the load to reposition and move further downwardly to enhance the crushing ability. The crushing undergoes its transition via 738 to state or condition 716. If there is still sensed an overpressure condition, apparatus 10 again transitions via 731, 732, 734, 736 and 738 and, of course, counting means 770 records such. However, if no overpressure condition exists at state 716 then apparatus 10 transitions via 718 to state 720.

Similarly as to the previously described action of apparatus 10 relative to 716, 731, 732, 734, 736 and 738 so too, such exists generally with regard to state or condition 720, transition 744 and second counting means 772.

At transition 718 apparatus 10 is approaching state or condition 720. However, if at that time an overpressure condition is experienced, the apparatus 10, instead of achieving state 720, continues along transition 740 to state or condition 742 which comprises a second counting means 772 effective to count the times that apparatus 10 has experienced the state or condition 742. Apparatus 10 undergoes the opening of the blade assemblies (as previously described with regard to 732, 734 and 736) to drop and reposition portions comprising the load to be crushed and then transitions via 744 to state or condition 716. If then there is no overpressure condition via 718, the apparatus 10 attains a condition or state 720 and continues via transition 722 to condition or state 724.

In the event that counter means 772 registers that the apparatus 10 has already cycled to that point its maximum number of allowed repeats, the apparatus then reverts as through transitions 743, 732 and 734 to state or-condition 736 and the process previously described with reference to state 736 and transition 738 leading to state 716 is repeated.

Having achieved the transition to state or condition 720, the apparatus 10 continues its transition through 722 to approaching state or condition 724. If at that time an overpressure condition is experienced the apparatus 10, instead of achieving state 724, continues along continues along transition 746 to state or condition 748 which comprises a third counting means 774 effective to count the times that apparatus 10 has experienced the state or condition 748. Apparatus 10 then transitions state 748, actuates counting means 774 and transitions via 750 to the state or condition 720. As apparatus 10 transitions via 722 and 724, if an overpressure condition exists apparatus 10 transitions via 752 to state 742 and, as hereinbefore explained and described, the blade assemblies are opened enabling pieces or members of the load to reposition and move further downwardly to enhance the crushing ability. The crushing undergoes its transitions as via 752 and 742.

When apparatus 10 finally transitions to state 724, it continues via 726 to state or condition 728 at which time the back blade assembly 252 and main blade assembly 350 are opened enabling the crushed material to be discharged as generally depicted in FIG. 27.

The counting means 770, 772 and 774 may be set to any desired values and such counting means may also keep track of the number of times that a particular loaded apparatus 10 passes through states: 748 and 742; 742 and 732; and 748, 742 and 732.

It should now be apparent that the invention provides many features and benefits.

Among such, for example, is the operation of the two crushing blades or jaw like members in a manner whereby the lower ends of blades or cutlery devices are maintained at least very close to each other, during the crushing function or operation, thereby preventing the work from falling out from between such blades. As hereinbefore disclosed, the main blade will operatively engage the back blade either directly or through the work situated between the blades and not only move the back blade toward its position against its coacting stops, but also during such movement crushing the work.

The back blade offers resistance to the movement of the main blade assembly toward the back blade and such is in the form of hydraulic resistance (FIGS. 23, 24 and 25). Such hydraulic resistance continues until, for example, the back blade engages its coacting stops 240, 248 while the main blade assembly may still continue crushing as depicted in FIG. 26.

The apparatus of the invention can be operated in an automatic fashion as described or under manual control as should now be apparent.

If the work is of such a configuration which does not permit the apparatus to crush it, the jaws, plates or cutlery devices open slightly, without dumping the work, causing the work to reposition itself and thereby enabling the jaws, plates or cutlery devices to crush the repositioned work. If then the work still does not permit the crushing thereof, the sequence is repeated with the work being further repositioned by itself and thereby permitting the jaws, plates or cutlery devices to crush the work. Although only a preferred embodiment of the invention has been disclosed and described it is apparent that other embodiments and modifications of the invention are possible within the scope of the appended claims.

What is claimed is:

1. A crushing—breaking apparatus, comprising a frame having side plates facing each other and spaced apart a predetermined distance, a first cutlery device provided in said frame, said first cutlery device comprising a plurality of first projection-shaped cutleries, a second cutlery device provided in said frame, said second cutlery device comprising a plurality of second projection-shaped cutleries, said plurality of second projection-shaped cutleries being disposed on said second cutlery device at locations offset relative to said first projection-shaped cutleries of said first cutlery device, first pivot means for pivotally supporting said first cutlery device, second pivot means for pivotally supporting said second cutlery device, said first cutlery device comprising a relatively upper and a relatively lower end, said second cutlery device comprising a relatively upper end and a relatively lower end, wherein said first pivot means is situated at least near said relatively upper end of said first cutlery device, wherein said second pivot means is situated at least near said relatively lower end of said second cutlery device, first abutment means effective for at times engaging said first cutlery device to thereby stop motion of said cutlery device about said first pivot means, second abutment means effective for at times engaging said second cutlery device to thereby stop motion of said second cutlery device about said second pivot means, first motor means operatively connected to said first cutlery device at an area thereof which is at least closer to said lower end of said first cutlery device than to said upper end of said first cutlery device, and second motor means operatively connected to said second cutlery device at an area thereof which is at least closer to said upper end of said second cutlery device than to said lower end of said second cutlery device, said first motor means being effective to pivotally move said first cutlery device about said first pivot means as to thereby move said relatively lower end of said first cutlery device toward said second cutlery device, said second motor means being effective to pivotally move said second cutlery device about said second pivot means and generally toward said first cutlery device, wherein said first cutlery device continues to so move toward said second cutlery device and said second cutlery device continues to so move toward said first cutlery device as to place said relatively lower end of said first cutlery device juxtaposed to said relatively lower end of said second cutlery device and to place said relatively upper ends of said first and second cutlery devices spaced from each other and defining an inlet for placing work to be crushed between said first cutlery device and said second cutlery device.

2. A crushing—breaking apparatus according to claim 1 wherein as said second cutlery device moves in a direction generally toward said first cutlery device said second cutlery device operatively engages said first cutlery device and moves said first cutlery device in a direction of movement as said second cutlery device is experiencing, and wherein said first cutlery device continues to be moved by said second cutlery device until said first cutlery device engages said first abutment means.

3. A crushing—breaking apparatus according to claim 1 and further comprising stop means, wherein as said second cutlery device moves in a direction generally toward said first cutlery device said second cutlery device operatively engages said first cutlery device and moves said first cutlery device in a direction of movement as said second cutlery device is experiencing, and wherein said first cutlery device continues to be moved by said second cutlery device until said first cutlery device engages said stop means thereby stopping movement of said first cutlery device, and wherein said second cutlery device continues in its movement generally toward said first cutlery device even after movement of said first cutlery device has been stopped by said stop means.

4. A crushing—breaking apparatus according to claim 3 and further comprising second stop means, and wherein said second cutlery device continues movement generally toward said first cutlery device after said first cutlery device has stopped in movement until said second cutlery device operatively engages said second stop means.

5. A crushing—breaking apparatus according to claim 1 wherein said first motor means comprises a first hydraulic cylinder assembly with a first housing and a first piston responsive to the pressure of hydraulic fluid supplied thereagainst, wherein said second motor means comprises a second hydraulic cylinder assembly with a second housing and a second piston responsive to the pressure of hydraulic fluid supplied thereagainst, and wherein the force of the first piston is maintained at a magnitude less than the force of said second piston.

6. A crushing—breaking apparatus according to claim 1 and further comprising means for sensing whether said second cutlery device is applying a force against said first cutlery device and the work carried between said first and second cutlery devices to be of a magnitude greater than a preselected magnitude, second means upon said force being sensed to be greater than said preselected magnitude being effective to cause at least said second cutlery device to be moved as to thereby increase the space between said first and second cutlery devices to enable the work to fall downwardly between said first and second cutlery devices thereby placing the work in a location wherein a greater mechanical crushing advantage by at least said second cutlery device is attained as to crush said work without requiring said force to be of a magnitude greater than said preselected magnitude.

7. A crushing—breaking apparatus according to claim 1 and further comprising first means for sensing whether said second cutlery device is tending to apply a force against said first cutlery device and the work carried between said first and second cutlery devices to be a magnitude greater than a preselected magnitude, second means upon said force being sensed to be greater than said preselected magnitude being effective to cause at least said second cutlery device to be moved as to thereby increase the space between said first and second cutlery devices to enable the work to fall downwardly between said first and second cutlery devices thereby placing the work in a new location wherein a greater mechanical crushing advantage by at least said second cutlery device is attained as to crush said work without requiring said force to be a magnitude greater than said preselected magnitude, wherein after said work has been placed in said new location and said first means is again sensing that said second cutlery device is again tending to apply a force against said first cutlery device and the work carried between said first and second cutlery devices to be a magnitude again greater than said preselected magnitude, said second means upon said force being again sensed to be greater than said preselected magnitude again being effective to again cause at least said second cutlery device to be moved as to thereby again increase the space between said first and second cutlery devices as to again enable the work to again fall further downwardly between said first and second cutlery devices thereby placing the work in a location different from said new location wherein a still greater mechanical crushing advantage by at least said second cutlery device is attained as to said work without requiring said force to be a magnitude greater than said predetermined magnitude.

* * * * *